US009925781B2

(12) United States Patent
Ono

(10) Patent No.: US 9,925,781 B2
(45) Date of Patent: Mar. 27, 2018

(54) MAINTENANCE SYSTEM OF INK JET RECORDING DEVICE

(71) Applicant: FUJIFILM Corporation, Tokyo (JP)

(72) Inventor: Takehisa Ono, Kangawa (JP)

(73) Assignee: FUJIFILM Corporation, Tokyo (JP)

( * ) Notice: Subject to any disclaimer, the term of this patent is extended or adjusted under 35 U.S.C. 154(b) by 88 days.

(21) Appl. No.: 15/288,369

(22) Filed: Oct. 7, 2016

(65) Prior Publication Data

US 2017/0021631 A1 Jan. 26, 2017

Related U.S. Application Data

(63) Continuation of application No. PCT/JP2015/059834, filed on Mar. 30, 2015.

(30) Foreign Application Priority Data

Apr. 21, 2014 (JP) ..... 2014-087183

(51) Int. Cl.
*B41J 2/165* (2006.01)
*B41J 2/01* (2006.01)

(52) U.S. Cl.
CPC ..... *B41J 2/16544* (2013.01); *B41J 2/01* (2013.01); *B41J 2/16535* (2013.01); (Continued)

(58) Field of Classification Search
CPC B41J 2/17566; B41J 2/16585; B41J 2/16535; B41J 2/16579; B41J 2/01; B41J 2002/16573; G06F 3/1244
See application file for complete search history.

(56) References Cited

U.S. PATENT DOCUMENTS

2010/0259576 A1* 10/2010 Mukaiyama ..... B41J 2/175 347/14
2011/0057971 A1* 3/2011 Yokoyama ..... B41J 2/17509 347/7

(Continued)

FOREIGN PATENT DOCUMENTS

JP H10-315489 A 12/1998
JP 2002-046289 A 2/2002

(Continued)

OTHER PUBLICATIONS

International Search Report issued in PCT/JP2015/059834; dated Jun. 16, 2015.

(Continued)

*Primary Examiner* — Patrick King
(74) *Attorney, Agent, or Firm* — Studebaker & Brackett PC

(57) ABSTRACT

Provided is a maintenance system of an ink jet recording device which appropriately maintains an ink jet head and efficiently processes a job. In an ink jet recording device that acquires a job relevant to image recording and sequentially executes the job, the ejection state of the ink jet head is detected before the next job is executed. The ejection abnormality level of the ink jet head is determined on the basis of the detection result. A maintenance execution criterion which is set in advance refers to, and the necessity of maintenance of the ink jet head is determined from the determination result of the ejection abnormality level. In a case where maintenance is required, the ink jet head is maintained before the next job is executed. On the other hand, in a case where maintenance is not required, the next job is performed.

18 Claims, 23 Drawing Sheets

(52) U.S. Cl.
CPC ..... *B41J 2/16552* (2013.01); *B41J 2/16579* (2013.01); *B41J 2/16585* (2013.01); *B41J 2002/1655* (2013.01); *B41J 2002/16558* (2013.01); *B41J 2002/16573* (2013.01)

(56) References Cited

U.S. PATENT DOCUMENTS

| | | | | |
|---|---|---|---|---|
| 2013/0128286 | A1* | 5/2013 | Tamagawa | G06K 15/02 358/1.2 |
| 2017/0021631 | A1* | 1/2017 | Ono | B41J 2/01 |

FOREIGN PATENT DOCUMENTS

| | | | |
|---|---|---|---|
| JP | 2004-209765 | A | 7/2004 |
| JP | 2005-119071 | A | 5/2005 |
| JP | 2005-288796 | A | 10/2005 |
| JP | 2006-244370 | A | 9/2006 |
| JP | 2006-256246 | A | 9/2006 |
| JP | 2011-056754 | A | 3/2011 |
| JP | 2011-152689 | A | 8/2011 |
| JP | 2012-011736 | A | 1/2012 |
| JP | 2012-223898 | A | 11/2012 |
| JP | 2013-052613 | A | 3/2013 |
| JP | 2013-078858 | A | 5/2013 |
| JP | 2013-123842 | A | 6/2013 |

OTHER PUBLICATIONS

International Preliminary Report on Patentability issued in PCT/JP2015/059834; dated Dec. 16, 2015.

* cited by examiner

MAINTENANCE SYSTEM OF INK JET RECORDING DEVICE

CROSS-REFERENCE TO RELATED APPLICATIONS

This application is a Continuation of PCT International Application No. PCT/JP2015/059834 filed on Mar. 30, 2015, which claims priority under 35 U.S.C. § 119 (a) to Japanese Patent Application No. 2014-087183 filed on Apr. 21, 2014. Each of the above application(s) is hereby expressly incorporated by reference, in its entirety, into the present application.

BACKGROUND OF THE INVENTION

1. Field of the Invention

The present invention relates to a maintenance system of an ink jet recording device which acquires a job relevant to image recording, and sequentially executes the job using an ink jet head.

2. Description of the Related Art

In an ink jet recording device, the occurrence of a fault in an ink jet head gives rise to the occurrence of an image quality defect in an image to be recorded. The fault phenomenon of the ink jet head causing an image quality defect is mainly non-ejection and a change in an ejection state (such as a defective ejection direction, a change in ejection rate, or a change in the amount of ejection). The occurrence of non-ejection or a change in an ejection state in specific nozzles gives rise to the occurrence of an image quality defect such as streaks or density unevenness in an image to be recorded. Therefore, in the ink jet recording device, it is important to maintain the ejection state of the ink jet head very satisfactorily. For this reason, in the ink jet recording device, the maintenance (processing of preventing and recovering from a fault) of the ink jet head is performed periodically.

JP2012-011736A proposes a method of selecting an optimal pattern from a plurality of maintenance patterns on the basis of the operating state of an ink jet recording device, and maintaining an ink jet head before a job, during the job, and after the job in accordance with the selected maintenance pattern, and a method of analyzing an recorded image on the basis of the result, selecting an optimal pattern from the plurality of maintenance patterns, and maintaining the ink jet head before the job, during the job, and after the job in accordance with the selected maintenance pattern.

In addition, JP1998-315489A (JP-H10-315489A) proposes a method of clocking a time elapsed after the execution of a job in an ink jet recording device that performs recovery processing on an ink jet head between jobs, and performing recovery processing on the ink jet head in a case where a certain period of time or more has elapsed before the next job is executed.

SUMMARY OF THE INVENTION

However, in the method disclosed in JP2012-011736A, the maintenance of the ink jet head is necessarily performed before or after the job, and thus there is a disadvantage in that time is taken to perform the entire process in a case where a plurality of jobs are processed continuously. In addition, there is also a disadvantage in that the life span of the ink jet head is shortened by its maintenance being performed frequently.

On the other hand, in the method disclosed in JP1998-315489A (JP-H10-315489A), there is an advantage in that a plurality of jobs can be processed in a short amount of time in a case where the jobs are processed. However, even in a case where a fault occurs in the ink jet head, a job is executed, and thus there is a concern of wasteful recording (recording in which a required image quality fails to be fulfilled) being performed.

The present invention is contrived in view of such circumstances, and an object thereof is to provide a maintenance system of an ink jet recording device which is capable of appropriately maintaining an ink jet head and efficiently processing a job.

Means for achieving the above object is as follows.

(1) A maintenance system of an ink jet recording device, including an ejection state detection portion that detects an ejection state of an ink jet head and a maintenance portion that maintains the ink jet head, which acquires a job relevant to image recording and sequentially executes the job, the maintenance system comprising: an ejection state detection control portion that controls the ejection state detection portion to detect the ejection state of the ink jet head during execution of the job or after the execution thereof; an ejection abnormality level determination portion that refers to an ejection abnormality level determination criterion which is set in advance, and determines an ejection abnormality level of the ink jet head on the basis of a detection result of the ejection state of the ink jet head obtained by the ejection state detection control portion; a maintenance determination portion that refers to a maintenance execution criterion which is set in advance, and determines whether the ink jet head is required to be maintained after the execution of the job having the ejection state detected therein and before execution of the next job, on the basis of a determination result of the ejection abnormality level determination portion; and a maintenance control portion that controls the maintenance portion to maintain the ink jet head, on the basis of a determination result of the maintenance determination portion.

According to the present aspect, the ejection state of the ink jet head is detected during the execution of the job or after the execution thereof. The ejection abnormality level of the ink jet head is determined on the basis of the detection result, and the necessity of maintenance of the ink jet head is determined on the basis of the determination result. As a result of this determination, in a case where maintenance is determined to be required, the ink jet head is maintained before the next job is executed. Thereby, it is possible to maintain the ink jet head at a suitable timing, and to efficiently process the job. In addition, it is possible to prevent maintenance from being performed more than necessary, and to extend the life span of the ink jet head.

(2) The maintenance system of an ink jet recording device according to the above (1), further comprising an output portion that outputs information of a plurality of acquired jobs and information of a progress status of the plurality of jobs.

According to the present aspect, the information of a plurality of acquired jobs and the information of the progress status of a plurality of jobs are output. Thereby, it is possible to ascertain the processing status of the job.

(3) The maintenance system of an ink jet recording device according to the above (2), wherein the maintenance portion is configured to be capable of executing multiple types of maintenance having different capabilities of recovering the ejection state, and the maintenance determination portion refers to a maintenance level determination criterion which is set in advance, and further determines a type of maintenance to be executed, on the basis of the determination result of the ejection abnormality level determination portion.

According to the present aspect, the maintenance portion is configured to be capable of executing multiple types of maintenance. In a case where maintenance is executed, the maintenance determination portion refers to the maintenance level determination criterion which is set in advance, and determines the type of maintenance to be executed, from the determination result of the ejection abnormality level determination portion. Thereby, it is possible to perform maintenance according to the ejection state of the ink jet head.

(4) The maintenance system of an ink jet recording device according to the above (3), further comprising a maintenance execution criterion correction portion that corrects the maintenance execution criterion.

According to the present aspect, it is possible to correct the maintenance execution criterion. Thereby, it is possible to arbitrarily set the maintenance execution criterion according to a user's desire. For example, in a case where the quality of an image to be recorded is raised, correction is performed in the direction of raising the maintenance execution criterion. Thereby, the necessity of maintenance is determined on a stricter criterion, and thus it is possible to maintain the high quality of an image to be recorded. On the other hand, in a case where the processing efficiency of the job is raised, correction is performed in the direction of lowering the maintenance execution criterion. Thereby, the shortening of a time which is taken to process the job is given priority over the quality of an image, and thus it is possible to efficiently process the job.

(5) The maintenance system of an ink jet recording device according to the above (4), further comprising a maintenance level determination criterion correction portion that corrects the maintenance level determination criterion.

According to the present aspect, it is possible to correct the maintenance level determination criterion. Thereby, it is possible to arbitrarily set the maintenance level determination criterion according to a user's desire. For example, in a case where the quality of an image to be recorded is raised, correction is performed in the direction of raising the maintenance level determination criterion. Thereby, the type of maintenance is determined on a stricter criterion, and thus it is possible to maintain the high quality of an image to be recorded. On the other hand, in a case where the processing efficiency of the job is raised, correction is performed in the direction of lowering the maintenance level determination criterion. Thereby, the shortening of a time which is taken to process the job is given priority over the quality of an image, and thus it is possible to efficiently process the job.

(6) The maintenance system of an ink jet recording device according to the above (5), further comprising an operation stoppage time information acquisition portion that acquires information of an operation stoppage time inserted between the plurality of jobs, wherein the maintenance execution criterion correction portion corrects the maintenance execution criterion on the basis of the information of the operation stoppage time acquired by the operation stoppage time information acquisition portion.

According to the present aspect, the maintenance execution criterion is corrected on the basis of the information of the operation stoppage time inserted between a plurality of jobs. For example, in a case where the operation stoppage time which is taken until the next job is executed becomes longer, the maintenance execution criterion is lowered, and maintenance is executed insofar as possible. Thereby, it is possible to effectively utilize an idle time, and to maintain the high quality of an image to be recorded. In addition, since maintenance performed in the future is executed ahead of schedule, it is possible to further raise the processing efficiency of the job.

(7) The maintenance system of an ink jet recording device according to the above (6), further comprising a maintenance level determination criterion correction portion that corrects the maintenance level determination criterion on the basis of the information of the operation stoppage time acquired by the operation stoppage time information acquisition portion.

According to the present aspect, the maintenance level determination criterion is corrected on the basis of the information of the operation stoppage time inserted between a plurality of jobs. For example, in a case where the operation stoppage time which is taken until the next job is executed becomes longer, the maintenance level determination criterion is lowered, and maintenance having as high a recovery capability as possible is executed. Thereby, it is possible to effectively utilize an idle time, and to maintain the high quality of an image to be recorded. In addition, since maintenance performed in the future is executed ahead of schedule, it is possible to further raise the processing efficiency of the job.

(8) The maintenance system of an ink jet recording device according to the above (6) or (7), further comprising: a job processing time calculation portion that calculates a plurality of job processing times using a time required for processing one job within the plurality of acquired jobs as a job processing time; and a remaining time calculation portion that acquires information of the plurality of job processing times calculated by the job processing time calculation portion and the information of the operation stoppage time acquired by the operation stoppage time information acquisition portion, and calculates a time which is taken until the plurality of acquired jobs are all terminated as a remaining time, wherein the output portion further outputs information of the remaining time calculated by the remaining time calculation portion.

According to the present aspect, a plurality of job processing times are calculated as a job processing time which is a time required for processing one job within a plurality of acquired jobs, and a time (remaining time) which is taken until all the jobs are terminated is calculated from information of the plurality of calculated job processing times and the information of the operation stoppage time. The information of the calculated remaining time is output. Thereby, it is possible to ascertain a time which is taken until all the jobs are terminated.

(9) The maintenance system of an ink jet recording device according to any one of the above (6) to (8), further comprising: a work information acquisition portion that acquires information of replenishment or replacement work of media to be used and/or information of replenishment or replacement work of ink; and an operation stoppage time calculation portion that calculates an operation stoppage time inserted between the jobs, on the basis of the information acquired by the work information acquisition portion, wherein the operation stoppage time information acquisition portion acquires information of the operation stoppage time inserted between the jobs from the operation stoppage time calculation portion.

According to the present aspect, the operation stoppage time is calculated on the basis of the information of replenishment or replacement work of media to be used and/or the information of replenishment or replacement work of ink.

The replenishment or replacement work of media or the replenishment or replacement work of ink are normally performed between a plurality of jobs, and an operation is stopped for a certain period of time in a case where the work is performed. Therefore, in a case where these pieces of information are used, it is possible to predict a timing at which an operation is stopped and an operation stoppage time. Consequently, in the present aspect, there is a configuration of calculating the operation stoppage time on the basis of the information of replenishment or replacement work of media to be used and/or the information of replenishment or replacement work of ink, and to automatically correct the maintenance execution criterion. Thereby, it is possible to further improve the processing efficiency of the job.

(10) The maintenance system of an ink jet recording device according to any one of the above (5) to (8), further comprising an image quality information acquisition portion that acquires information of image quality required for an image to be recorded, wherein the maintenance execution criterion correction portion corrects the maintenance execution criterion on the basis of the information acquired by the image quality information acquisition portion.

According to the present aspect, the maintenance execution criterion is automatically corrected on the basis of the information of image quality required for an image to be recorded. Thereby, it is possible to execute maintenance more appropriately. In this case, for example, as the required image quality increases, correction is performed in the direction of lowering the maintenance execution criterion. That is, even in a case where the ejection abnormality level is low, the correction thereof is performed so that maintenance is executed.

(11) The maintenance system of an ink jet recording device according to any one of the above (5) to (10), further comprising an image quality information acquisition portion that acquires information of image quality required for an image to be recorded, wherein the maintenance level determination criterion correction portion corrects the maintenance level determination criterion on the basis of the information acquired by the image quality information acquisition portion.

According to the present aspect, the maintenance level determination criterion is automatically corrected on the basis of the information of image quality required for an image to be recorded. Thereby, it is possible to execute maintenance more appropriately. In this case, for example, the correction thereof is performed so that, as the required image quality increases, maintenance having high recovery capability is executed earlier. That is, even in a case where the ejection abnormality level is low, the correction thereof is performed so that maintenance having high recovery capability is executed.

(12) The maintenance system of an ink jet recording device according to any one of the above (5) to (8), further comprising an image type information acquisition portion that acquires information relating to the type of image to be recorded as image type information, wherein the maintenance execution criterion correction portion corrects the maintenance execution criterion on the basis of the image type information acquired by the image type information acquisition portion.

According to the present aspect, the maintenance execution criterion is automatically corrected on the basis of the information relating to the type of image to be recorded (image type information). Thereby, it is possible to execute maintenance more appropriately. That is, since the required image qualities are different from each other depending on the type of image, the maintenance execution criterion is corrected in accordance with the type of image. For example, in a case where a commercial poster is printed, and a case where printed matter of only characters is printed, the required image qualities are different from each other, the maintenance execution criterion is appropriately corrected in accordance with the type of image.

(13) The maintenance system of an ink jet recording device according to any one of the above (5) to (10), further comprising an image type information acquisition portion that acquires information relating to the type of image to be recorded as image type information, wherein the maintenance level determination criterion correction portion corrects the maintenance level determination criterion on the basis of the image type information acquired by the image type information acquisition portion.

According to the present aspect, the maintenance level determination criterion is automatically corrected on the basis of the information relating to the type of image to be recorded (image type information). Thereby, it is possible to execute maintenance more appropriately.

(14) The maintenance system of an ink jet recording device according to any one of the above (5) to (8), further comprising a media type information acquisition portion that acquires information relating to the type of media to be used as media type information, wherein the maintenance execution criterion correction portion corrects the maintenance execution criterion on the basis of the media type information acquired by the media type information acquisition portion.

According to the present aspect, the maintenance execution criterion is automatically corrected on the basis of the information relating to the type (material, thickness, size, or the like) of media to be used (media type information). Thereby, it is possible to execute maintenance more appropriately. That is, since the required image qualities are different from each other depending on the type of media to be used, the maintenance execution criterion is corrected in accordance with the type of media.

(15) The maintenance system of an ink jet recording device according to any one of the above (5) to (10), further comprising a media type information acquisition portion that acquires information relating to the type of media to be used as media type information, wherein the maintenance level determination criterion correction portion corrects the maintenance level determination criterion on the basis of the media type information acquired by the media type information acquisition portion.

According to the present aspect, the maintenance level determination criterion is automatically corrected on the basis of the information of the type of media to be used (media type information). Thereby, it is possible to execute maintenance more appropriately. That is, since the required image qualities are different from each other depending on the type of media to be used, the maintenance level determination criterion is corrected in accordance with the type of media.

(16) The maintenance system of an ink jet recording device according to any one of the above (5) to (8), further comprising a mode setting portion that sets an operating mode of the ink jet recording device, wherein the maintenance execution criterion correction portion corrects the maintenance execution criterion on the basis of information of the operating mode set by the mode setting portion.

According to the present aspect, the maintenance execution criterion is automatically corrected in accordance with the operating mode of the ink jet recording device. Thereby, it is possible to execute maintenance more appropriately. For example, in a case where a standard mode, an image quality priority mode, and a time priority mode can be set as the operating mode, the maintenance execution criterion is corrected in a case where the image quality priority mode and the time priority mode are set. In this case, in a case where the image quality priority mode is set, correction is performed in the direction of lowering the maintenance execution criterion. That is, even in a case where the ejection abnormality level is low, the correction thereof is performed so that maintenance is executed. Thereby, it is possible to satisfactorily maintain the ejection state at all times. On the other hand, in a case where the time priority mode is set, correction is performed in the direction of raising the maintenance execution criterion. That is, even in a case where the ejection abnormality level is slightly high, the correction thereof is performed so that maintenance is not executed. Thereby, it is possible to process the job efficiently.

(17) The maintenance system of an ink jet recording device according to any one of the above (5) to (10), further comprising a mode setting portion that sets an operating mode of the ink jet recording device, wherein the maintenance level determination criterion correction portion corrects the maintenance level determination criterion on the basis of the information of the operating mode set by the mode setting portion.

According to the present aspect, the maintenance level determination criterion is automatically corrected in accordance with the operating mode of the ink jet recording device. Thereby, it is possible to execute maintenance more appropriately. For example, in a case where a standard mode, an image quality priority mode, and a time priority mode can be set as the operating mode, the maintenance level determination criterion is corrected in a case where the image quality priority mode and the time priority mode are set. In this case, in a case where the image quality priority mode is set, the correction thereof is performed so that maintenance having high recovery capability is executed early. That is, even in a case where the ejection abnormality level is low, the correction thereof is performed so that maintenance having high recovery capability is executed. On the other hand, even in a case where the time priority mode is set, the correction thereof is performed so that maintenance having low recovery capability (that is, maintenance having a short processing time) is preferentially executed.

(18) The maintenance system of an ink jet recording device according to any one of the above (1) to (17), further comprising an image reading portion that reads an image recorded on media, wherein the ejection state detection portion detects the ejection state of the ink jet head on the basis of the image read by the image reading portion.

According to the present aspect, an image recorded on media is read, and the ejection state of the ink jet head is detected on the basis of the read image.

(19) The maintenance system of an ink jet recording device according to any one of the above (1) to (17), further comprising imaging means for imaging a nozzle surface of the ink jet head, wherein the ejection state detection portion detects the ejection state of the ink jet head on the basis of an image of the nozzle surface imaged by the imaging means.

According to the present aspect, the nozzle surface of the ink jet head is imaged by the imaging means, and the ejection state of the ink jet head is detected on the basis of the obtained image. That is, it is possible to ascertain the contamination state of the nozzle surface from the image of the nozzle surface, and to estimate the ejection state (ejection bending or non-ejection occurs due to the contamination state of the nozzle surface).

(20) The maintenance system of an ink jet recording device according to the above (17), wherein the imaging means images the nozzle surface by receiving infrared light.

According to the present aspect, the nozzle surface is imaged by receiving infrared light. Thereby, it is possible to ascertain the contamination state of the inside portion of the nozzles, and to detect the ejection state more appropriately.

(21) The maintenance system of an ink jet recording device according to any one of the above (1) to (20), wherein the ink jet head is configured such that a plurality of head modules are replaceably engaged with each other, the maintenance portion is configured to be capable of executing maintenance in units of the head modules, the ejection state detection portion detects the ejection state in units of the head modules, the ejection abnormality level determination portion determines the ejection abnormality level in units of the head modules, the maintenance determination portion determines a necessity of maintenance in units of the head modules, and the maintenance control portion causes the maintenance portion to maintain the ink jet head in units of the head modules.

According to the present aspect, the ink jet head is configured such that a plurality of head modules are replaceably engaged with each other. The maintenance portion is configured to be capable of maintaining in units of head modules so as to correspond to this configuration of the ink jet head. In addition, the ejection state detection portion is configured to be capable of detecting the ejection state in units of head modules. Further, the level determination portion is configured to be capable of determining the ejection abnormality level in units of head modules. The maintenance determination portion determines the necessity of maintenance in units of head modules, and the maintenance control portion executes maintenance in units of head modules. Thereby, it is possible to shorten a time required for maintenance. That is, since only a head module requiring maintenance is maintained, it is possible to shorten the entire maintenance time. In addition, since only a head module requiring maintenance is maintained, and can be replaced in units of head modules in a case of its failure, it is also possible to extend the life span of the ink jet head as a whole.

According to the present invention, it is possible to appropriately maintain the ink jet head, and to efficiently process the job.

DESCRIPTION OF THE PREFERRED EMBODIMENTS

Hereinafter, a preferred embodiment of the present invention will be described in detail with reference to the accompanying drawings.

<<Entire Configuration of Ink Jet Recording Device>>

First, the entire configuration of an ink jet recording device will be described.

Figure 1:
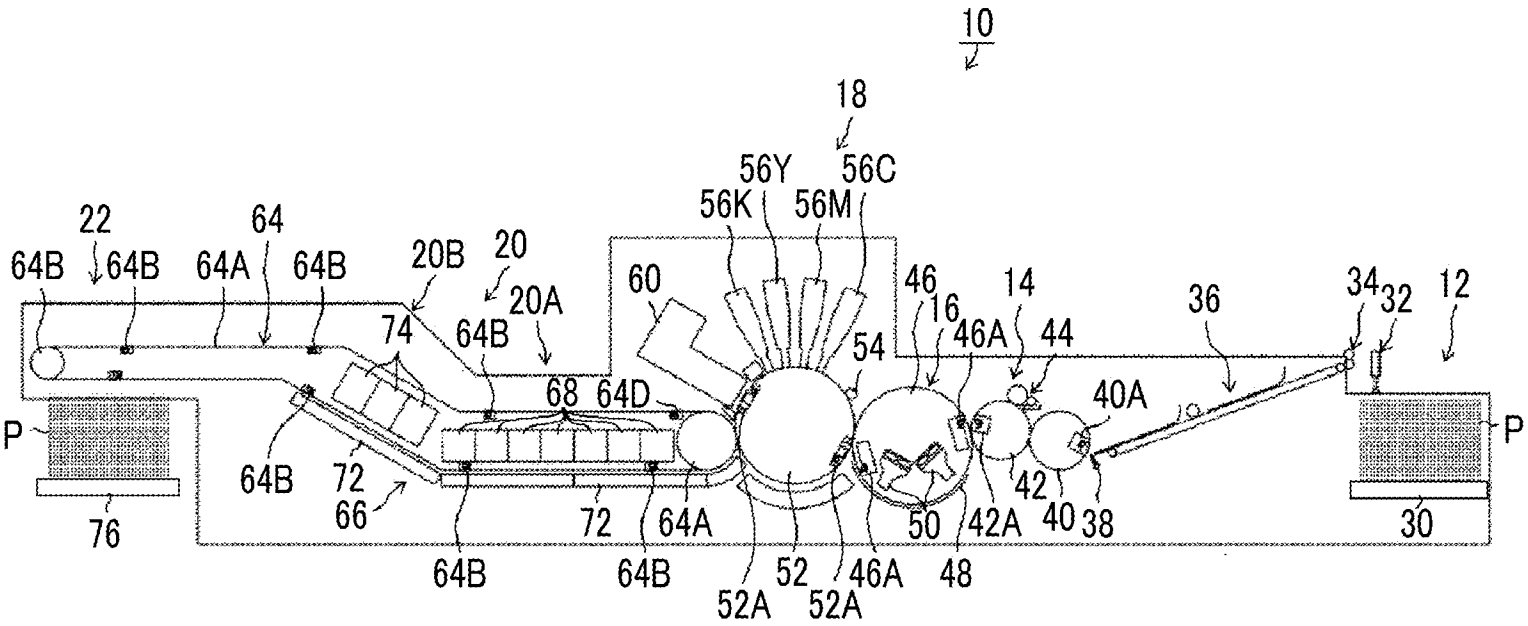
FIG. 1 is an entire configuration diagram illustrating a schematic configuration of the entirety of an ink jet recording device.

FIG. 1 is an entire configuration diagram illustrating a schematic configuration of the entirety of an ink jet recording device.

An ink jet recording device 10 is a color ink jet printer that performs color printing on flat paper (hereinafter, referred to as "paper") using an ink jet system.

As shown in FIG. 1, the ink jet recording device 10 is configured to include a paper feed portion 12, a treatment liquid coating portion 14, a treatment liquid drying portion 16, a drawing portion 18, a post-processing portion 20, a paper discharge portion 22, and a maintenance portion 24 (not shown in FIG. 1). The paper feed portion 12 feeds paper P as media. The treatment liquid coating portion 14 coats a treatment liquid fed from the paper feed portion 12 on the paper P. The treatment liquid drying portion 16 dries the paper P having the treatment liquid coated thereon. The drawing portion 18 ejects ink droplets onto the dried paper P using an ink jet system and draws a color image. The post-processing portion 20 post-processes the drawn paper P. The paper discharge portion 22 discharges and recovers the paper P on which ultraviolet irradiation is performed.

<Paper Feed Portion>

The paper feed portion 12 feeds the paper P which is media one by one to the treatment liquid coating portion 14. The paper feed portion 12 is configured to mainly include a paper feed stand 30, a sucker device 32, a paper feed roller pair 34, a feeder board 36, a front stop 38, and a paper feed drum 40.

The paper feed stand 30 is a stand for placing the paper P. A large number of paper P stacked in the state of a bundle (paper bundle) are placed on the paper feed stand 30. This paper feed stand 30 includes a paper feed stand elevation device which is not shown. The paper feed stand elevation device elevates the paper feed stand 30 in conjunction with an increase or decrease in the paper P so that the paper P located at a highest position is located at the position of a constant height at all times.

The sucker device 32 takes up the paper P stacked on the paper feed stand 30, one by one, in order from above, and feeds the paper to the paper feed roller pair 34.

The paper feed roller pair 34 sends out the paper P fed from the sucker device 32 toward the feeder board 36.

The feeder board 36 receives the paper P sent out from the paper feed roller pair 34, and transports the paper toward the paper feed drum 40.

The front stop 38 is provided at the terminal position of the feeder board 36, and corrects the posture of the paper P transported by the feeder board 36.

The paper feed drum 40 receives the paper P o which the posture is corrected by the front stop 38 from the feeder board 36, and transports the paper to the treatment liquid coating portion 14. The paper feed drum 40 includes a gripper 40A, and grasps and rotates the distal end of the paper P using this gripper 40A, to thereby transport the paper P to the treatment liquid coating portion 14.

The paper P is fed at a constant period by the paper feed portion 12.

<Treatment Liquid Coating Portion>

The treatment liquid coating portion 14 coats a predetermined treatment liquid on the paper P.

In a case where general-purpose printing paper (which is not so-called ink jet exclusive paper, but cellulose-based paper coated paper used in general offset printing or the like) is used as the paper P, feathering, breeding or the like occurs, which leads to a deterioration in the quality of an image. For this reason, in a case where general-purpose printing paper is used as the paper P, a liquid (treatment liquid) having a function of agglutinating color material components in ink is coated on the paper P by this treatment liquid coating portion 14.

The treatment liquid coating portion 14 is configured to mainly include a treatment liquid coating drum 42 that transports the paper P and a treatment liquid coating device 44 that coats a treatment liquid on the paper P.

The treatment liquid coating drum 42 receives the paper P from the paper feed drum 40 of the paper feed portion 12, and transports the paper P along a predetermined transport path. The treatment liquid coating drum 42 includes a gripper 42A, and grasps and rotates the distal end of the paper P using this gripper 42A, to thereby wind the paper P around its circumferential surface and transport the paper P.

The treatment liquid coating device 44 presses a coating roller against the paper P transported by the treatment liquid coating drum 42, and coats a treatment liquid on the paper P.

In the course of the paper P being transported by the treatment liquid coating drum 42, the coating roller is brought into compressive contact with its surface. Thereby, a treatment liquid is coated on the paper P.

<Treatment Liquid Drying Portion>

The treatment liquid drying portion 16 dries the paper P having a treatment liquid coated thereon. This treatment liquid drying portion 16 is configured to mainly include a treatment liquid drying drum 46 that transports the paper P, a paper guide 48 that guides the paper P, and a treatment liquid drying unit 50 that dries the paper P.

The treatment liquid drying drum 46 receives the paper P from the treatment liquid coating drum 42 of the treatment liquid coating portion 14, and transports the paper P along a predetermined transport path. The treatment liquid drying drum 46 includes grippers 46A, and grasps and rotates the distal end of the paper P using these grippers 46A, to thereby transport the paper P.

The paper guide 48 is disposed along the transport path of the paper P on the treatment liquid drying drum 46, and guides the paper P.

The treatment liquid drying unit 50 is installed inside the treatment liquid drying drum 46, and sends hot air toward the paper guide 48. Thereby, hot air is blown onto the surface (surface having a treatment liquid coated thereon) of the paper P which is transported by the treatment liquid drying drum 46.

In the course of the paper P being transported by the treatment liquid drying drum 46, the hot air sent from the treatment liquid drying unit 50 is blown onto its surface, and the paper is dried. An ink agglutination layer is formed on the surface of the paper P by such a drying process.

<Drawing Portion>

The drawing portion 18 ejects ink of each color of C, M, Y, and K onto the paper P, and draws a color image on the paper P. The drawing portion 18 is configured to mainly include a drawing drum 52 that transports the paper P, a paper pressing roller 54, ink jet heads 56C, 56M, 56Y, and 56K, and a scanner 60. The paper pressing roller 54 tightly attaches the paper P to the circumferential surface of the drawing drum 52. The ink jet heads 56C, 56M, 56Y, and 56K eject ink droplets of each color of C, M, Y, and K onto the paper P. The scanner 60 reads an image recorded on the paper P.

The drawing drum 52 which is an example of transport means of the paper P receives the paper P from the treatment liquid drying drum 46 of the treatment liquid drying portion 16, and transports the paper P along a predetermined transport path. The drawing drum 52 includes grippers 52A, and grasps and rotates the distal end of the paper P using these grippers 52A, to thereby wind the paper P around its circumferential surface and transport the paper P. In addition, the drawing drum 52 includes a large number of absorption holes (not shown) on its circumferential surface, and adsorptively holds the paper P wound around its circumferential surface by suctioning the paper P from these absorption holes.

The paper pressing roller 54 presses the surface of the paper P delivered from the treatment liquid drying drum 46 to the drawing drum 52, and presses the paper P against the circumferential surface of the drawing drum 52. Thereby, the paper P is attached tightly onto the circumferential surface of the drawing drum 52.

The ink jet heads 56C, 56M, 56Y, and 56K are constituted by line-type ink jet heads equivalent to the width of the paper P. The respective ink jet heads 56C, 56M, 56Y, and 56K are disposed at regular intervals along the transport path of the paper P, and are disposed at right angles to the transport direction of the paper P.

Meanwhile, the ink jet recording device 10 of the present embodiment, since the paper P is rotated and transported by the drawing drum 52, the respective ink jet heads 56C, 56M, 56Y, and 56K are disposed obliquely in the vicinity of the drawing drum 52. For this reason, a nozzle surface provided at the distal end of each of the ink jet heads 56C, 56M, 56Y, and 56K is disposed obliquely with respect to the horizontal plane.

The configuration of each of the ink jet heads 56C, 56M, 56Y, and 56K will be described later in more detail.

The scanner 60 is an example of an image reading portion, and reads an image (such as, for example, a test chart) recorded on the paper P by the ink jet heads 56C, 56M, 56Y, and 56K. As described later, the ejection state of each of the ink jet heads 56C, 56M, 56Y, and 56K is detected on the basis of the image which is read by this scanner 60.

In the course of the paper P being transported by the drawing drum 52, ink droplets are ejected from each of the ink jet heads 56C, 56M, 56Y, and 56K, and an image is drawn on the surface the paper.

The scanner 60 reads, as necessary, the image (such as, for example, a test chart) recorded on the paper P. Defective ejection such as non-ejection or defective ejection direction is detected on the basis of the image which is read by this scanner 60.

<Post-Processing Portion>

The post-processing portion 20 performs post-processing (drying and ultraviolet irradiation) on the paper P having an image drawn thereon. The post-processing portion 20 is configured to include an ink drying portion 20A that performs a drying process, an ultraviolet irradiation portion 20B that irradiates the dried paper P with ultraviolet (UV) to fix an image, and a chain gripper 64 that transports the paper P.

The chain gripper 64 receives the paper P from the drawing portion 18, and transports the paper P from a predetermined transport path. The chain gripper 64 grasps the distal end of the paper P using grippers 64B included in a traveling endless chain 64A, and transports the paper P.

The paper P is transported to the chain gripper 64, and is transported to the paper discharge portion 22 through a first interval which is flattened, a second interval having a constantly ascending slope, and a third interval which is flattened.

Guide plates 72 that guide the transport of the paper P are disposed in the first interval and the second interval. Each of the guide plates 72 has a large number of absorption holes (not shown) on the sliding surface of the paper P, and suctions the paper P from these absorption holes. Thereby, tensile force (back tension) is imparted to the paper P which is transported along the guide plates 72 by the chain gripper 64.

The ink drying portion 20A heats and dries the paper P after drawing, and removes liquid components remaining on the surface of the paper P. The ink drying portion 20A includes a dryer 68 that sends hot air. The dryer 68 is installed inside the chain gripper 64, and sends hot air toward the paper P which is transported in the first interval.

The ultraviolet irradiation portion 20B irradiates the surface of an image with ultraviolet (UV) rays. In a case where ultraviolet curable ink is used as ink, the surface of an image is irradiated with ultraviolet rays in this ultraviolet irradiation portion 20B. The ultraviolet irradiation portion 20B includes an ultraviolet irradiation device 74 that performs irradiation with ultraviolet rays. The ultraviolet irradiation device 74 is installed inside the chain gripper 64, and irradiates the paper P which is transported in the second interval with ultraviolet rays.

The paper P which is transported by the chain gripper 64 first passes through the ink drying portion 20A, and is dried by hot air being blown onto the surface of an image during passing therethrough. Thereafter, the paper P passes through the ultraviolet irradiation portion 20B, and the surface of an image is irradiated with ultraviolet rays during passing therethrough (in a case where ultraviolet curable ink is used as ink). Thereby, an image is fixed onto the paper P.

<Paper Discharge Portion>

The paper discharge portion 22 recovers paper P having an image drawn thereon. The paper discharge portion 22 includes a paper discharge stand 76 that stacks and recovers the paper P. The chain gripper 64 releases the paper P on the paper discharge stand 76, and stacks the paper P on the paper discharge stand 76. The paper discharge stand 76 is provided with paper stops (such as a front sheet stop, a rear sheet stop, and a lateral sheet stop) (not shown) so that the paper P released from the chain gripper 64 is stacked in an orderly manner. In addition, the paper discharge stand 76 is provided with a paper discharge stand elevation device which is not shown, and has the height thereof adjusted so that the paper P located at a highest position is located at a constant height at all times.

<Maintenance Portion>

The maintenance portion 24 maintains the ink jet heads 56C, 56M, 56Y, and 56K. The maintenance portion 24 is disposed adjacent to the drawing portion 18. The ink jet heads 56C, 56M, 56Y, and 56K move to this maintenance portion 24, and receive various types of maintenance. The configuration of the maintenance portion 24 will be described later in detail.

<<Control System>>

Figure 2:
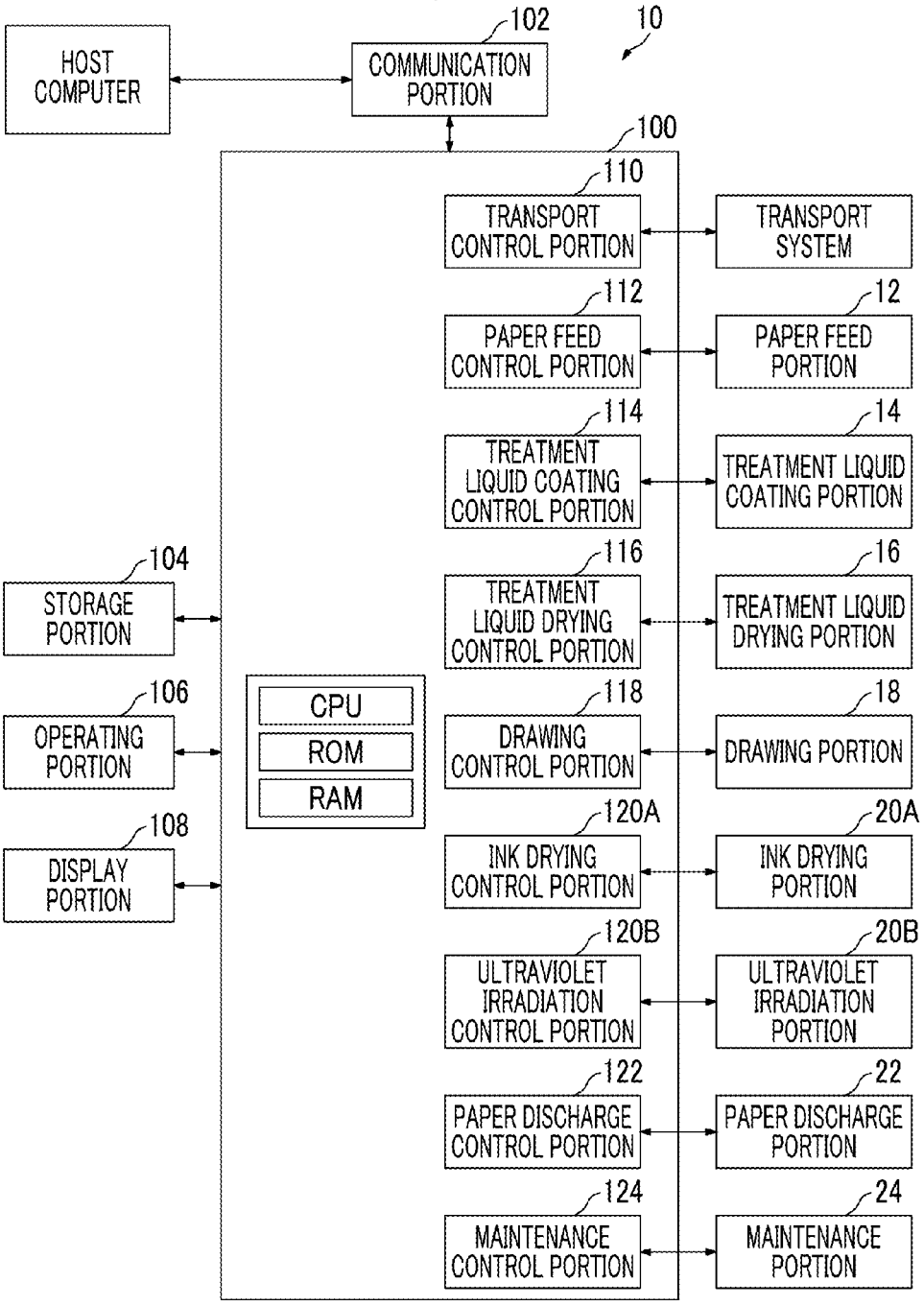
FIG. 2 is a block diagram illustrating a schematic configuration of a control system of the ink jet recording device.

FIG. 2 is a block diagram illustrating a schematic configuration of a control system of the ink jet recording device shown in FIG. 1.

As shown in the same drawing, the ink jet recording device 10 includes a system controller 100, a communication portion 102, a storage portion 104, an operating portion 106, a display portion 108, and the like.

The system controller 100 is constituted by a microcomputer including a central processing unit (CPU), a read only member (ROM), a random access memory (RAM) and the like, and realizes various functions by executing a predetermined control program. That is, the system controller executes the predetermined control program, to thereby function as a transport control portion 110 that controls a transport system, a paper feed control portion 112 that controls the paper feed portion 12, a treatment liquid coating control portion 114 that controls the treatment liquid coating portion 14, a treatment liquid drying control portion 116 that controls the treatment liquid drying portion 16, a drawing control portion 118 that controls the drawing portion 18, an ink drying control portion 120A that controls the ink drying portion 20A, an ultraviolet irradiation control portion 120B that controls the ultraviolet irradiation portion 20B, a paper discharge control portion 122 that controls the paper discharge portion 22, a maintenance control portion 124 that controls the maintenance portion 24, and the like. In addition, the system controller executes the predetermined image processing program, to thereby function as an image processing portion. A control program executed by this system controller 100 and various types of data required for control are stored in the ROM.

The communication portion 102 includes a required communication interface, and transmits and receives data to and from a host computer connected to the communication interface.

The storage portion 104 functions as temporary storage means of various types of data including image data, and can read and write data through the system controller 100.

The operating portion 106 includes required operating means (such as, for example, operation buttons, a keyboard, or a touch panel), and outputs operation information, input from the operating means, to the system controller 100. The system controller 100 executes various types of processes in accordance with the operation information which is input from this operating portion 106.

The display portion 108 includes required display device (such as, for example, a liquid crystal panel), and displays required information on the display device in accordance with a command from the system controller 100.

The system controller 100 functioning as the transport control portion 110 controls the transport system of the paper P (the feeder board 36, the front stop 38 and the paper feed drum 40 of the paper feed portion 12, the treatment liquid coating drum 42 of the treatment liquid coating portion 14, the treatment liquid drying drum 46 of the treatment liquid drying portion 16, the drawing drum 52 of the drawing portion 18, and the chain gripper 64 of the post-processing portion 20). Specifically, paper transport means of each portion is controlled so that the paper P which is fed from the paper feed portion 12 is transported to the paper discharge portion 22 without any delay.

The system controller 100 functioning as the paper feed control portion 112 controls the driving of the sucker device 32 and the paper feed stand elevation device which are included in the paper feed portion 12 so that the paper P stacked on the paper feed stand 30 is fed one by one in order.

The system controller 100 functioning as the treatment liquid coating control portion 114 controls the driving of the treatment liquid coating device 44 included in the treatment liquid coating portion 14 so that a treatment liquid is coated on the paper P which is transported by the treatment liquid coating drum 42.

The system controller 100 functioning as the treatment liquid drying control portion 116 controls the driving of the treatment liquid drying unit 50 included in the treatment liquid drying portion 16 so that the paper P which is transported by the treatment liquid drying drum 46 is dried.

The system controller 100 functioning as the drawing control portion 118 controls the driving of the ink jet heads 56C, 56M, 56Y, and 56K so that a predetermined image is recorded on the paper P which is transported by the drawing drum 52. In addition, the operation of the scanner 60 is controlled so that the recorded image is read.

The system controller 100 functioning as the ink drying control portion 120A controls the driving of the dryer 68 included in the ink drying portion 20A so that hot air is sent to the paper P which is transported by the chain gripper 64.

The system controller 100 functioning as the ultraviolet irradiation control portion 120B controls the driving of the ultraviolet irradiation device 74 included in the ultraviolet irradiation portion 20B so that the paper P which is transported by the chain gripper 64 is irradiated with ultraviolet rays.

The system controller 100 functioning as the paper discharge control portion 122 controls the driving of the paper discharge stand elevation device or the like paper included in the paper discharge portion 22 so that the paper P is stacked on the discharge stand 76.

The system controller 100 functioning as the maintenance control portion 124 controls the maintenance portion 24 so that predetermined maintenance is executed.

A job relevant to image recording is fetched from the host computer through the communication portion 102 to the ink jet recording device 10. Information of image data included in the job is stored in the storage portion 104.

The system controller 100 generates dot data by performing required signal processing on the image data stored in this storage portion 104. The driving of the respective ink jet heads 56C, 56M, 56Y, and 56K of the drawing portion 18 is controlled in accordance with the generated dot data, and an image indicated by the image data is recorded on paper.

The dot data is generated by generally performing a color conversion process and a half-tone process on image data. The color conversion process is a process of converting image data (for example, RGB 8-bit image data) represented by sRGB or the like into ink amount data of each color of ink used in the ink jet recording device 10 (in the present example, converting the image data into ink amount data of each color of C, M, Y, and K). The half-tone process is a process of converting the ink amount data of each color generated by the color conversion process into dot data of each color using a process such as error diffusion.

The system controller 100 generates dot data of each color by performing the color conversion process and the half-tone process on the image data. An image indicated by the image data is recorded on paper by controlling the driving of a corresponding ink jet head in accordance with the generated dot data of each color.

<<Recording Operation Performed by Ink Jet Recording Device>>

Next, an outline of an image recording operation performed by the ink jet recording device 10 configured in this manner will be given.

As described above, the job relevant to image recording is fetched from the host computer through the communication portion 102 to the ink jet recording device 10.

The job includes various information required for printing such as information of the number of sheets to be printed, in addition to the image data of an image to be printed on the paper P. The ink jet recording device 10 can receive jobs continuously. When the job is received, the ink jet recording device 10 stores the received job in the storage portion 104 and manages the job. The ink jet recording device 10 sequentially executes the jobs in the order of reception.

When the job is received, the system controller 100 first performs required signal processing on image data included in the received job, and generates dot data.

After the dot data has been generated, the system controller 100 executes a printing process of the number of sheets designated in accordance with the contents of the job. The printing process is performed in the following procedure.

In the treatment liquid coating portion 14, the paper P fed from the paper feed portion 12 first has a treatment liquid coated on its surface (printing surface). Next, in the treatment liquid drying portion 16, hot air is blown onto the surface, and the coated treatment liquid is dried. Next, in the drawing portion 18, ink droplets of C, M, Y, and K are ejected onto the surface, and an image is drawn on the surface. Next, in the post-processing portion 20, an ink drying process and an ultraviolet irradiation process are performed on the paper P having an image drawn thereon, and an image is fixed onto the paper P. The printing process for one piece of paper P is completed by a series of processes as described above. The paper on which the ultraviolet irradiation process is terminated is transported to the paper discharge portion 22, and is stacked on the paper discharge stand 76.

In a case where multiple printing is performed in one job, the aforementioned processed are continuously performed. That is, the paper P is continuously fed from the paper feed portion 12 at a constant period, and the printing process is continuously performed.

When one job is completed, the ink jet head 56 moves to a standby position, and stands by in preparation for the next job.

<<Ink Jet Head>>

Next, the ink jet heads 56C, 56M, 56Y, and 56K will be described.

Meanwhile, the ink jet recording device 10 of the present embodiment is provided with four ink jet heads 56C, 56M, 56Y, and 56K, but the configurations of the respective ink jet heads 56C, 56M, 56Y, and 56K are the same as each other, and thus the configurations will be described herein using the common sign 56.

Figure 3:
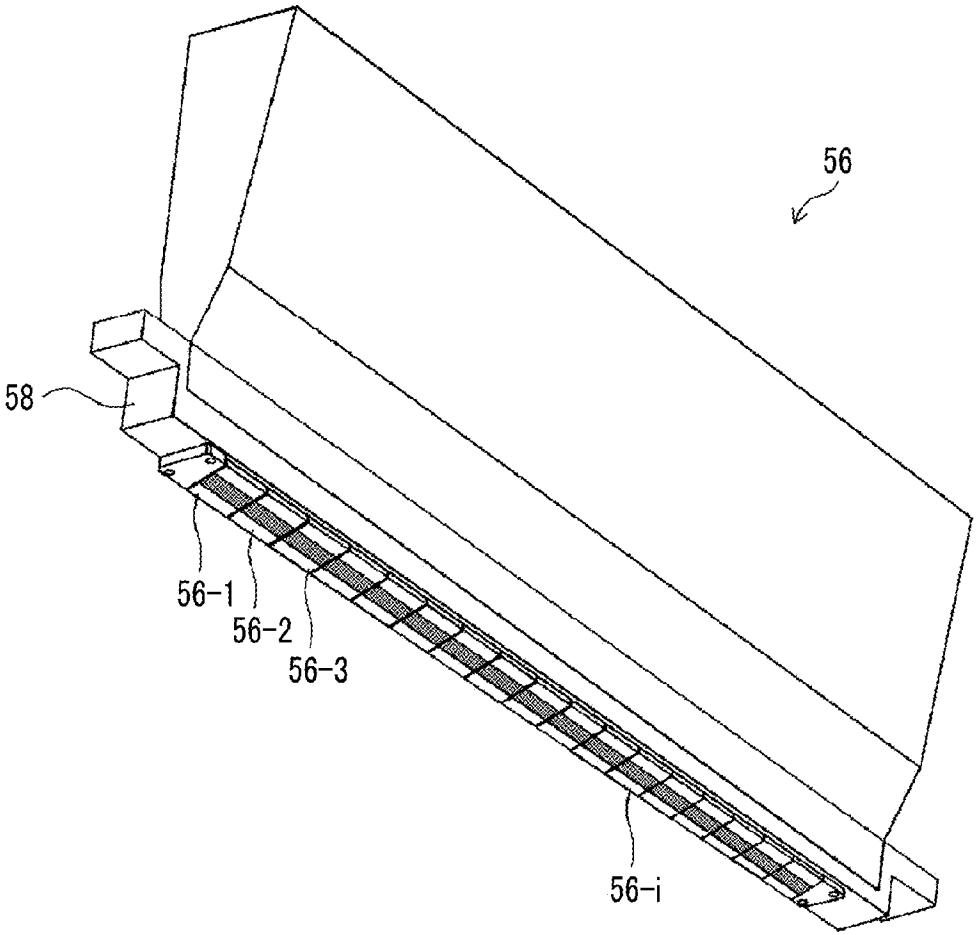
FIG. 3 is a perspective view illustrating a schematic configuration of an ink jet head.

FIG. 3 is a perspective view illustrating a schematic configuration of the ink jet head.

As described above, the ink jet head 56 is constituted by a line-type ink jet head. Particularly, the ink jet head 56 of the present embodiment is configured such that one ink jet head is formed by engaging a plurality of head modules 56-I in a horizontal line.

The respective head modules 56-*i* are attached to a bar frame 58, and are formed integrally with each other. The bar frame 58 includes mounting portions (not shown) for mounting the respective head modules 56-*i*, and the respective head modules 56-*i* are detachably and attachably mounted on these mounting portions. Therefore, the respective head modules 56-*i* can be individually replaced.

The ink jet head 56 having the head module 56-*i* engaged therewith is provided with a nozzle surface 57 on its distal end portion.

Figure 4:
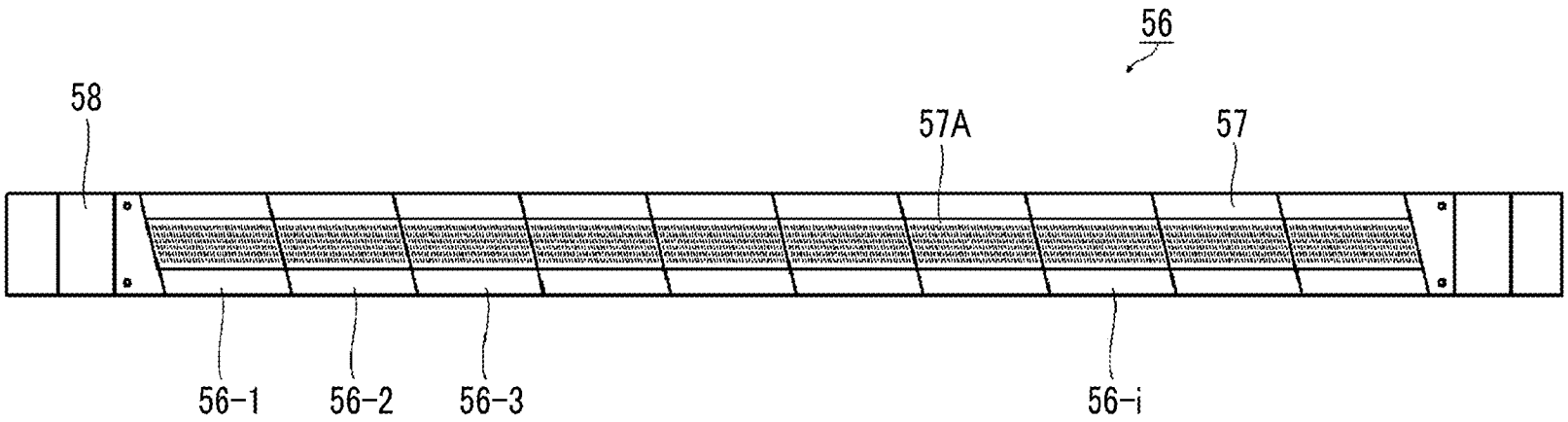
FIG. 4 is a plan view of a nozzle surface of the ink jet head.

FIG. 4 is a plan view of the nozzle surface of the ink jet head.

The nozzle surface 57 has a rectangular shape as a whole, and is provided with a belt-like nozzle array region 57A on the central portion (central portion in a direction perpendicular to a longitudinal direction). The nozzles are included in the nozzle array region 57A.

Figure 5:
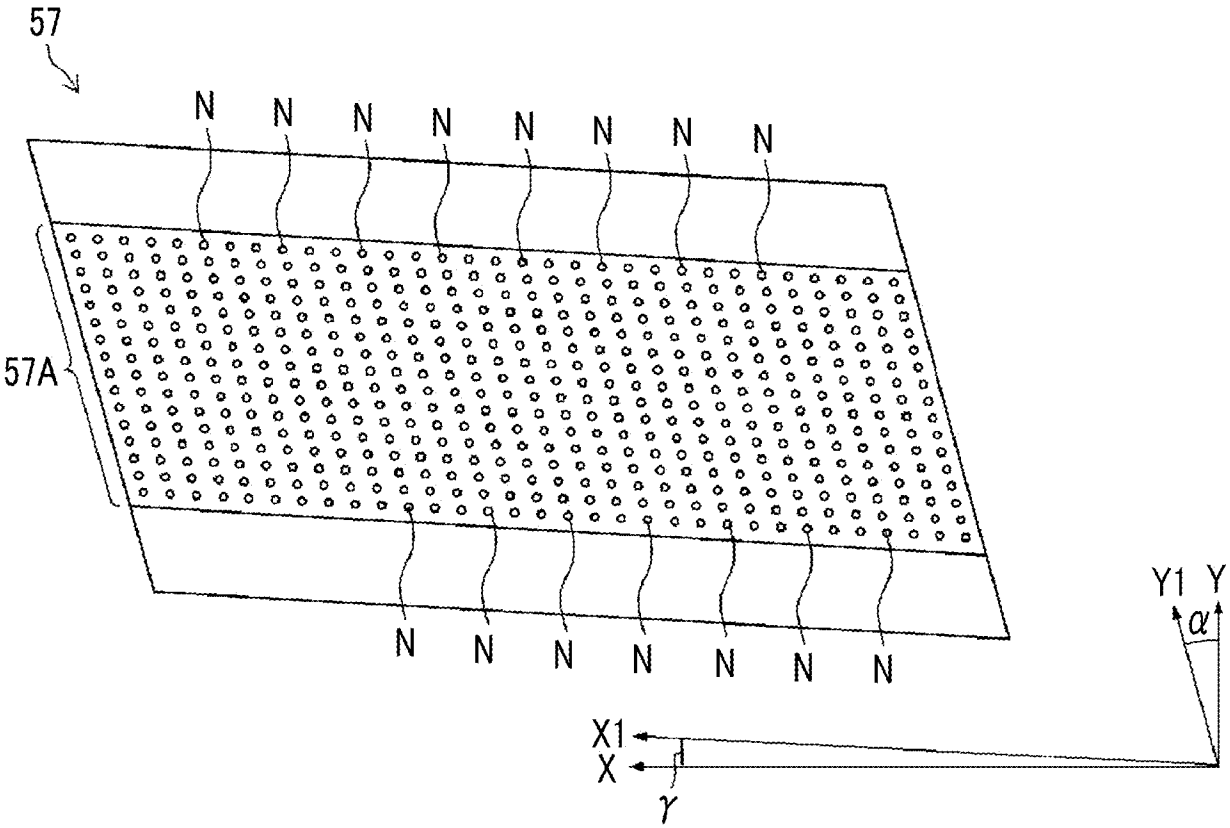
FIG. 5 is an enlarged plan view of a portion of the nozzle surface.

FIG. 5 is an enlarged plan view of a portion of the nozzle surface (nozzle surface of one head module).

In FIG. 5, the direction of the X-axis is a longitudinal direction of the ink jet head 56 (the direction of the Y-axis is a direction along the transport direction of the paper P during drawing).

As shown in FIG. 5, in the ink jet head 56 of the present embodiment, nozzles N are arrayed in a matrix. More specifically, the nozzles N are arrayed at a constant pitch along a straight line X1 which is inclined at a predetermined angle ($\gamma$) with respect to the X-axis, and the nozzles N are arrayed at a constant pitch along a straight line Y1 which is inclined at a predetermined angle ($\alpha$) with respect to the Y-axis. The nozzles N are arrayed in this manner, and thus it is possible to narrow the substantial interval between the nozzles N projected in a longitudinal direction (main scanning direction (X direction)), and to array the nozzles N at a high density. Meanwhile, the substantial array direction of the nozzles N in this case is set to the direction of the X-axis. That is, the nozzles N are arrayed substantially in the longitudinal direction of the ink jet head 56.

Liquid repellent processing is performed on the nozzle array region 57A. Thereby, it is possible to prevent contaminations from being attached to the vicinity of the nozzles N.

<<Maintenance Portion>>

Figure 6:
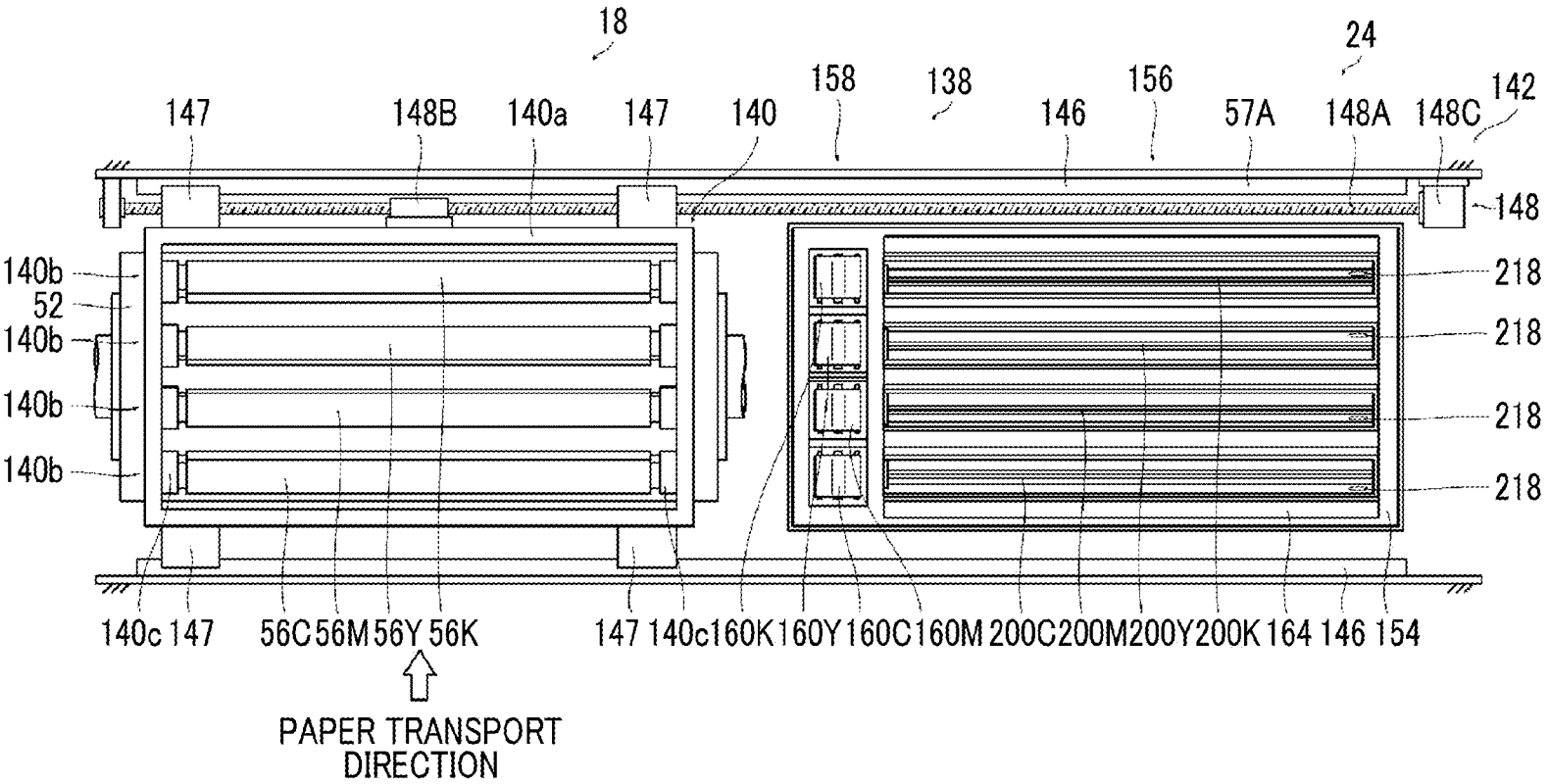
FIG. 6 is a plan view of a maintenance portion and a drawing portion.

FIG. 6 is a plan view of the maintenance portion and the drawing portion.

As shown in FIG. 6, the maintenance portion 24 is disposed adjacent to the drawing portion 18. In a case where the maintenance of the ink jet heads 56C, 56M, 56Y, and 56K are performed, the maintenance thereof is performed by moving the ink jet heads 56C, 56M, 56Y, and 56K to the maintenance portion 24. For this reason, the ink jet recording device 10 is provided with a head moving device 138 as movement means for moving the ink jet heads 56C, 56M, 56Y, and 56K. First, the configuration of this head moving device 138 will be described.

<Head Moving Device>

The head moving device 138 is configured to include a head mounting frame 140 for mounting the ink jet heads 56C, 56M, 56Y, and 56K, and a head mounting frame moving device 142 for horizontally moving the head mounting frame 140.

The head mounting frame 140 includes a head mounting frame body 140*a*. The head mounting frame body 140*a* includes a head mounting portion 140*b* for mounting each of the ink jet heads 56C, 56M, 56Y, and 56K. The head mounting portion 140*b* includes a pair of head support portions 140*c*, and is configured such that both ends of each of the ink jet heads 56C, 56M, 56Y, and 56K are supported by the head support portions 140*c*, and that the ink jet heads 56C, 56M, 56Y, and 56K are horizontally supported.

In a case where the respective ink jet heads 56C, 56M, 56Y, and 56K are mounted to the head mounting frame 140, the ink jet heads are arrayed so that the direction (longitudinal direction) of the nozzle array is orthogonal to the transport direction of the paper P due to the drawing drum 52 (arrayed in parallel to the rotating shaft of the drawing drum 52). In addition, the ink jet heads are arrayed obliquely so as to eject ink droplets at right angles to the paper P which is transported by the drawing drum 52. As a result, the respective ink jet heads 56C, 56M, 56Y, and 56K are arrayed so that nozzle surface is inclined with respect to the horizontal plane.

The head mounting portion 140*b* is provided with head elevation means, not shown, for elevating each of the ink jet heads 56C, 56M, 56Y, and 56K mounted to the head mounting portion 140*b*. The head elevation means elevates each of the ink jet heads 56C, 56M, 56Y, and 56K mounted to the head mounting portion 140*b* along the radial direction of the drawing drum 52 (elevates each of the ink jet heads in a direction perpendicular to the nozzle surface of each of the ink jet heads 56C, 56M, 56Y, and 56K mounted to the head mounting portion 140*b*).

The head mounting frame moving device 142 horizontally moves the head mounting frame 140 along the longitudinal direction of the ink jet heads 56C, 56M, 56Y, and 56K. The head mounting frame moving device 142 is configured to include a pair of guide rails 146 and a feeding device 148.

The pair of guide rails 146 are horizontally disposed along the rotating shaft of the drawing drum 52 (disposed so as to be orthogonal to the transport direction of the paper P due to the drawing drum 52). The head mounting frame 140 is slidably supported through sliders 147 by these guide rails 146.

The feeding device 148 is configured to include a screw rod 148A, a nut member 148B which is threadably engaged with the screw rod 148A, and a motor 148C that rotates the screw rod 148A. The screw rod 148A is disposed along the guide rail 146. The nut member 148B is threadably engaged with the screw rod 148A, and is coupled to the head mounting frame 140. Thereby, when the screw rod 148A is rotated, the head mounting frame 140 moves along the guide rail 146. The motor 148C rotatably drives the screw rod 148A forward and rearward.

When the motor 148C is rotated forward, the head mounting frame 140 moves from the drawing portion 18 toward the maintenance portion along the guide rail 146. In addition, when the motor 148C is rotated rearward, the head mounting frame 140 moves from the maintenance portion toward the drawing portion 18 along the guide rail 146.

The head moving device 138 is configured in this manner. When the motor 148C is driven, the ink jet heads 56C, 56M, 56Y, and 56K horizontally move along a longitudinal direction. The ink jet heads 56C, 56M, 56Y, and 56K horizontally move along the longitudinal direction, and thus horizontally move between a drawing position and a standby position.

Meanwhile, the drawing position refers to the installation position of each of the ink jet heads 56C, 56M, 56Y, and 56K during drawing. Therefore, the drawing position is set on the transport path of the paper P due to the drawing drum 52. The ink jet heads 56C, 56M, 56Y, and 56K are located at the drawing position, and thus are arrayed on the drawing drum 52. Thereby, an image can be drawn by ejecting ink droplets onto the paper P which is transported by the drawing drum 52.

The standby position refers to the installation position of each of the ink jet heads 56C, 56M, 56Y, and 56K during standby, during power-off, and during maintenance. The drawing position is set at a position other than the transport path of the paper P due to the drawing drum 52. The ink jet heads 56C, 56M, 56Y, and 56K are located at the standby position, and thus are retreated from above the drawing drum 52.

<Maintenance Portion>

The maintenance portion 24 is configured to include a wiping unit 158 for wiping the nozzle surfaces of the ink jet heads 56C, 56M, 56Y, and 56K, a cap unit 156 for capping the nozzle surfaces of the ink jet heads 56C, 56M, 56Y, and 56K (covering the nozzle surfaces with a cap), and a waste liquid tray 154.

[Wiping Unit]

The wiping unit 158 is disposed on the movement path of the ink jet heads 56C, 56M, 56Y, and 56K that move between the drawing position and the standby position. The wiping unit 158 includes wiping devices 160C, 160M, 160Y, and 160K that individually wipe the nozzle surfaces of the respective ink jet heads 56C, 56M, 56Y, and 56K. The wiping devices 160C, 160M, 160Y, and 160K wipe the nozzle surfaces of the ink jet heads 56C, 56M, 56Y, and 56K in the course of the ink jet heads 56C, 56M, 56Y, and 56K moving between the drawing position and the standby position.

Figure 7:
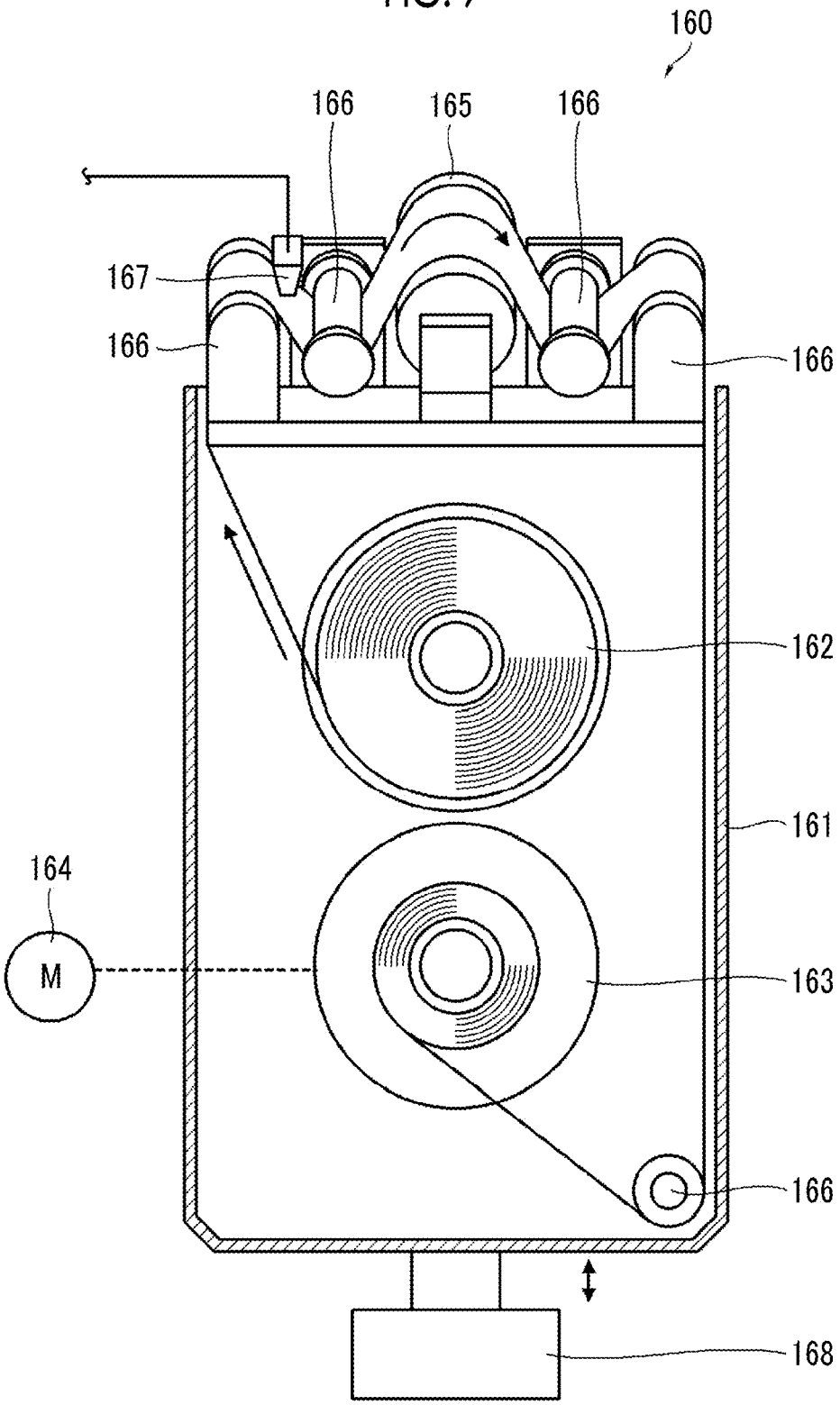
FIG. 7 is a schematic configuration diagram of a wiping device.

FIG. 7 is a schematic configuration diagram of the wiping device.

Meanwhile, the basic configurations of the respective wiping devices 160C, 160M, 160Y, and 160K are the same as each other, and thus the configuration of the wiping device will be described herein using a sign 160.

The wiping device 160 presses a wet web (belt-like sheet) W against the nozzle surface 57 of the ink jet head 56 (56C, 56M, 56Y, 56K) moving along a longitudinal direction, and wipes the nozzle surface 57 of the ink jet head 56.

The wiping device 160 is configured to include a supply reel 162 that supplies the web W to a body frame 161, a winding reel 163 that winds the web W, a web driving motor 164 that rotates and drives the winding reel 163, a pressing roller 165 that presses the web W against the nozzle surface 57, a plurality of guide members 166 that guide the traveling of the web W, a cleaning liquid supply nozzle 167 that supplies a cleaning liquid to the web W, and an elevation device 168.

The web W is constituted by, for example, textile fabrics or knit fabrics made of fine fiber, and is formed to have substantially the same width as the width (width in a direction perpendicular to a longitudinal direction) of the nozzle surface.

The supply reel 162 supplies the web W. The web W is wound in a roll shape around this supply reel 162.

The winding reel 163 winds the web W reeled out from the supply reel 162. The web W is wound in a roll shape around this winding reel 163.

The web driving motor 164 rotates and drives the winding reel 163. By rotating and driving the winding reel 163, the web W is reeled out from the supply reel 162, and is wound around the winding reel 163. Thereby, the web W travels between the supply reel 162 and the winding reel 163.

The pressing roller 165 brings the web W traveling between the supply reel 162 and the winding reel 163 into contact with the nozzle surface 57. The pressing roller 165 is constituted by a rubber roller, and is obliquely disposed in accordance with the inclination of the nozzle surface 57 of the ink jet head 56 that performs wiping.

The plurality of guide members 166 perform guiding so that the web W reeled out from the supply reel 162 and wound around the winding reel 163 is smoothly wound around the inclined pressing roller 165.

The cleaning liquid supply nozzle 167 is disposed on the upstream side of the pressing roller 165 in the traveling direction of the web W, and supplies a cleaning liquid to the web W on the upstream side of the pressing roller 165. The cleaning liquid supply nozzle 167 receives the supply of a cleaning liquid from a cleaning liquid supply device which is not shown, and supplies the cleaning liquid to the web W.

The elevation device 168 is constituted by a cylinder, and elevates the body frame 161 in a vertical direction. The pressing roller 165 causes this elevation device 168 to elevate the body frame 161, and thus moves between a contact position and a retreat position.

When the ink jet head 56 is moved from the standby position to the drawing position or is moved from the drawing position to the standby position in a state where the pressing roller 165 is located at the contact position, the web W wound around the pressing roller 165 comes into contact with the nozzle surface 57 of the ink jet head 56. Thereby, the nozzle surface 57 is wiped.

On the other hand, in a case where the ink jet head 56 is moved in a state where the pressing roller 165 is located at the retreat position, it is possible to move the ink jet head 56 without contacting the web W. That is, it is possible to move the ink jet head 56 without wiping.

[Cap Unit]

The cap unit 156 includes caps 200C, 200M, 200Y, and 200K that cap the nozzle surfaces of the respective ink jet heads 56C, 56M, 56Y, and 56K. The respective caps 200C, 200M, 200Y, and 200K cap the nozzle surfaces of the ink jet heads 56C, 56M, 56Y, and 56K which are located at the standby position. For this reason, the respective caps 200C, 200M, 200Y, and 200K are arranged corresponding to the arrangement positions of the ink jet heads 56C, 56M, 56Y, and 56K when being located at the standby position. That is, the respective caps 200C, 200M, 200Y, and 200K are arranged immediately below the ink jet heads 56C, 56M, 56Y, and 56K when being located at the standby position.

Each of the caps 200C, 200M, 200Y, and 200K has a bottomed box shape of which the upper portion is opened, and receives the distal end portion of each of the ink jet heads 56C, 56M, 56Y, and 56K to cap the nozzle surface. In the ink jet recording device 10 of the present embodiment, since the ink jet heads 56C, 56M, 56Y, and 56K are installed obliquely, the caps 200C, 200M, 200Y, and 200K are also arranged obliquely.

The ink jet heads 56C, 56M, 56Y, and 56K move to the standby position, and thus are arranged immediately above the caps 200C, 200M, 200Y, and 200K. The ink jet heads 56C, 56M, 56Y, and 56K move toward the caps 200C, 200M, 200Y, and 200K, and thus are configured such that the distal end portions are received in the caps 200C, 200M, 200Y, and 200K, and that the nozzle surfaces are capped.

Figure 8:
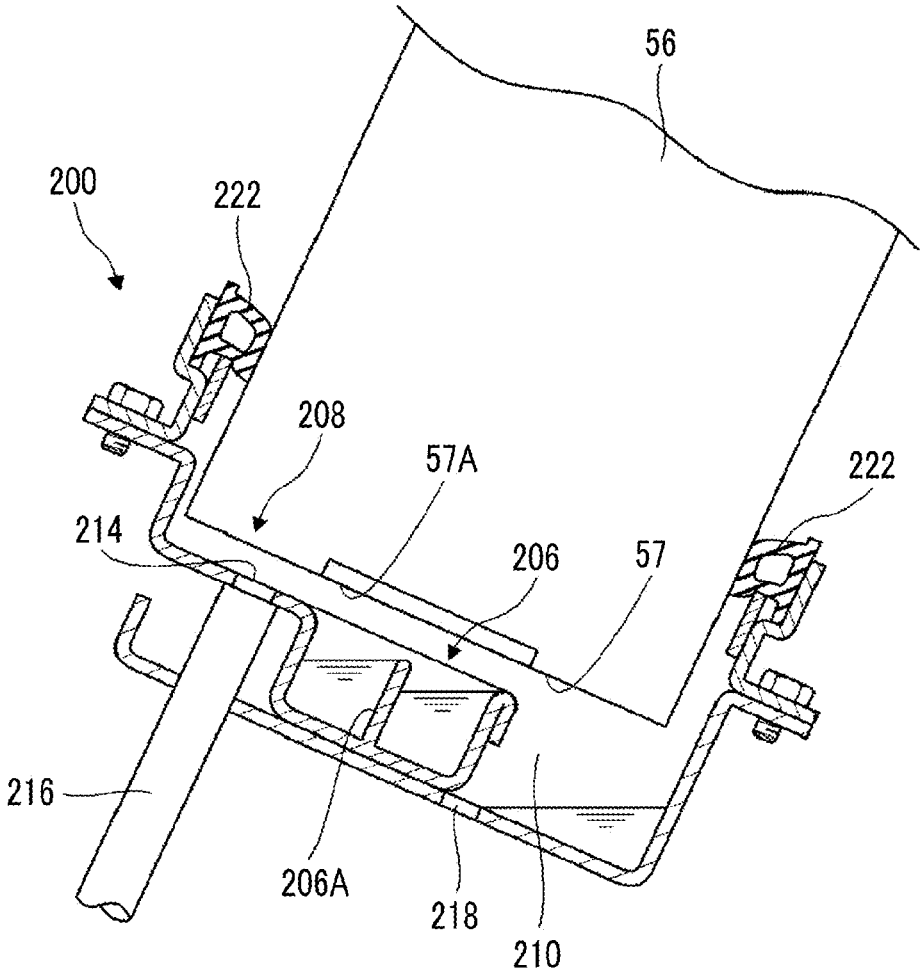
FIG. 8 is a cross-sectional view illustrating a configuration of a cap.

FIG. 8 is a cross-sectional view illustrating a configuration of the cap.

Meanwhile, the basic configurations of the respective caps 200C, 200M, 200Y, and 200K are the same as each other, and thus the configuration of the cap will be described herein using a sign 200.

As described above, the cap 200 has a bottomed box shape o which the upper portion is opened. Particularly, the cap 200 of the present embodiment has a long box shape corresponding to the shape (long square-pillar shape) of the distal end portion of the line-type ink jet head 56.

The cap 200 includes a moisturizing liquid storage portion 206 for storing a moisturizing liquid therein, a moisturizing liquid supply portion 208 for supplying a moisturizing liquid to the moisturizing liquid storage portion 206, and a drain portion 210.

The moisturizing liquid storage portion 206 has a groove shape, and is disposed at the central portion of the bottom of the cap 200 along the longitudinal direction of the cap 200. The moisturizing liquid storage portion 206 has the same width as that of the nozzle array region 57A, and includes a partition plate 206A therein. The partition plate 206A divides the moisturizing liquid storage portion 206 into two parts in a direction perpendicular to the longitudinal direction. In a case where the distal end portion of the ink jet head 56 is received in the cap 200, the nozzle array region 57A included in the nozzle surface 57 is disposed facing the moisturizing liquid storage portion 206.

The moisturizing liquid supply portion 208 is constituted by a surface having a substantially the same height as that of the upper edge portion of the moisturizing liquid storage portion 206, and is disposed in parallel to the moisturizing liquid storage portion 206. The moisturizing liquid supply portion 208 includes a moisturizing liquid supply port 214 for supplying a moisturizing liquid to the moisturizing liquid storage portion 206. A moisturizing liquid supply tube 216 is connected to the moisturizing liquid supply port 214. The moisturizing liquid supply tube 216 is connected to a moisturizing liquid supply device which is not shown. In a case where a moisturizing liquid is supplied from the moisturizing liquid supply device, the moisturizing liquid is supplied from the moisturizing liquid supply port 214 into the cap 200. The supplied moisturizing liquid flow through the moisturizing liquid supply portion 208, and is stored in the moisturizing liquid storage portion 206.

The drain portion 210 has a groove shape, and is disposed in parallel to the moisturizing liquid storage portion 206. The drain portion 210 has a drain hole 218. The drain hole 218 is disposed at an end in opposite direction to an end at which an entrance portion 202 of the cap 200 is disposed. That is, the drain hole 218 is disposed at an end on the standby position side in the movement direction of the ink jet head 56. A moisturizing liquid overflowing from the moisturizing liquid storage portion 206 or ink purged from the ink jet head 56 is recovered in the drain portion 210, and is wasted from the drain hole 218. The ink or the like wasted from the drain hole 218 is recovered in the waste liquid tray 154.

The cap 200 includes a seal member 222 on the inner circumference of an opening. The seal member 222 is constituted by an elastic member such as, for example, rubber, a brush, or felt.

The cap 200 is configured in this manner. After the ink jet head 56 is located at the standby position, the ink jet head moves toward the cap 200, and thus is configured such that the distal end portion is received in the cap 200, and that the nozzle surface 57 is capped.

Meanwhile, there is purging as one kind of maintenance of the ink jet head 56, but this purging is performed using the cap 200. That is, the inside of the ink jet head 56 is pressurized in a state where the distal end portion is received in the cap 200, and ink is discharged from the nozzles. Thereby, ink discharged from the nozzles can be recovered in the cap 200 by the purging.

In addition, preliminary ejection (also referred to as dummy jet or flushing) is also performed using the cap 200.

Meanwhile, in a case where is performed, the purging is performed in a state where the ink jet head 56 is slightly lifted, and the nozzle surface 57 is separated from the moisturizing liquid storage portion 206. Thereby, it is possible to prevent the purged ink from coming into contact with the moisturizing liquid storage portion 206. The purged ink is recovered in the drain portion 210, and is recovered from the drain hole 218.

[Waste Liquid Tray]

The waste liquid tray 154 is disposed at a position downward of the wiping devices 160C, 160M, 160Y, and 160K, and the caps 200C, 200M, 200Y, and 200K. A waste liquid tank is connected to the waste liquid tray 154 through waste liquid recovery piping which is not shown. The ink or the like purged in the caps 200C, 200M, 200Y, and 200K is wasted to the waste liquid tray 154, and is recovered in the waste liquid tank.

<<Maintenance System>>

In order to maintain the performance of the ink jet recording device 10, the ejection states of the ink jet heads 56C, 56M, 56Y, and 56K is required to be maintained satisfactorily at all times. For this reason, it is necessary to appropriately maintain the ink jet heads 56C, 56M, 56Y, and 56K. On the other hand, excessive maintenance inhibits the progress of job processing, and shortens the life span of the ink jet heads 56C, 56M, 56Y, and 56K. Consequently, in the ink jet recording device 10 of the present embodiment, the optimization of the maintenance of the ink jet heads 56C, 56M, 56Y, and 56K is achieved by maintenance system 300 described below.

This maintenance system 300 detects the ejection states of the ink jet heads 56C, 56M, 56Y, and 56K for each job, and determines the ejection abnormality levels of the ink jet heads 56C, 56M, 56Y, and 56K on the basis of the detection results. The maintenance system 300 performs the maintenance of the ink jet heads 56C, 56M, 56Y, and 56K on the basis of the determined ejection abnormality levels. That is, in a case where maintenance is determined to be required, maintenance is performed before the next job is performed. In a case where maintenance is determined not to be required, the next job is performed continuously. Thereby, it is possible to efficiently process the jobs while constantly maintaining the quality of an image to be printed on the paper P.

Figure 9:
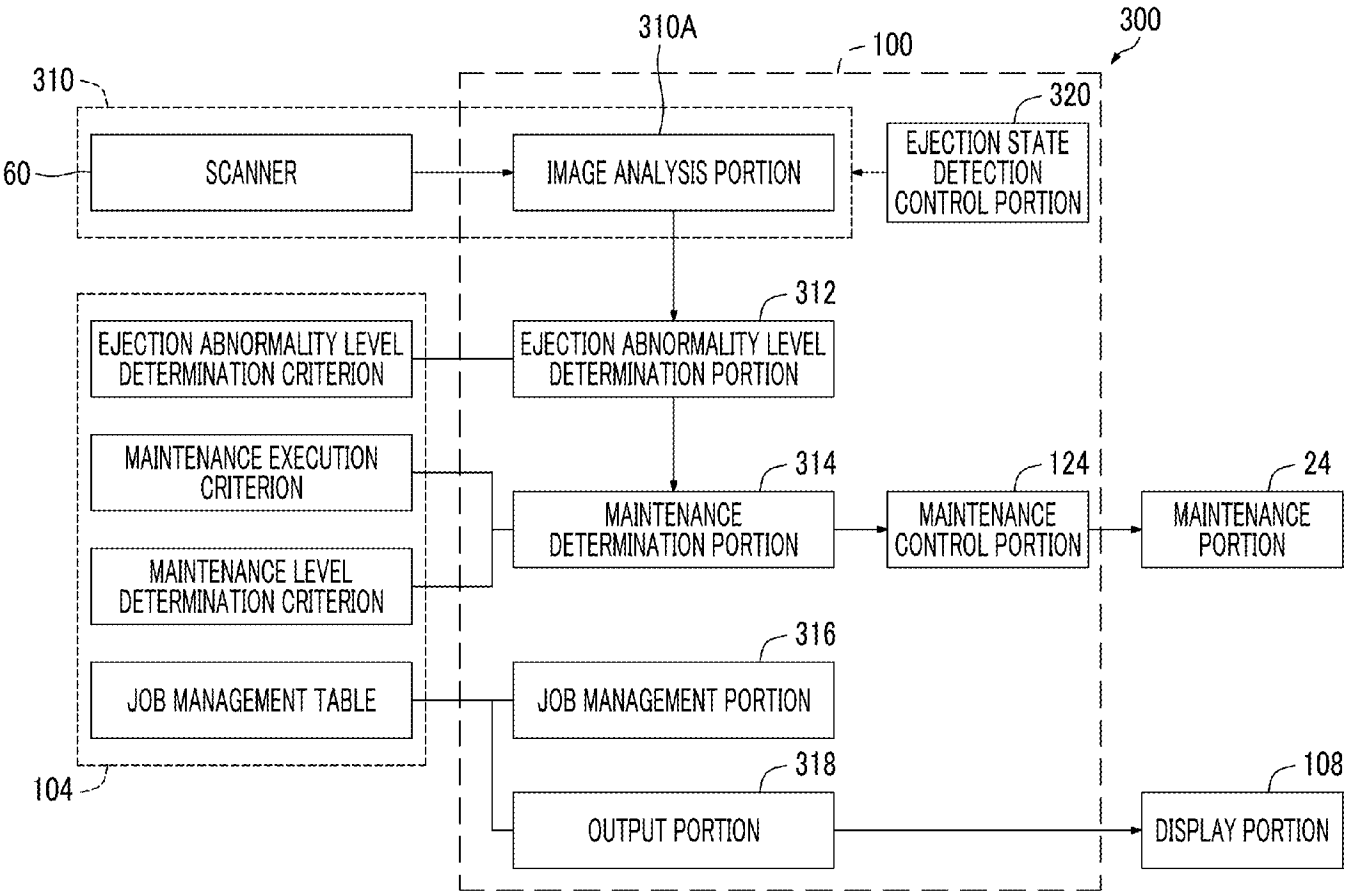
FIG. 9 is a system configuration diagram of a maintenance system.

FIG. 9 is a system configuration diagram of the maintenance system.

The maintenance system 300 is configured to include an ejection abnormality level determination portion 312, a maintenance determination portion 314, and a maintenance control portion 124. The ejection abnormality level determination portion 312 determines the ejection abnormality levels of the ink jet heads 56C, 56M, 56Y, and 56K from the detection results of the ejection states of the ink jet heads 56C, 56M, 56Y, and 56K. The maintenance determination portion 314 determines the necessity of maintenance and its contents on the basis of the determination result of the ejection abnormality level determination portion 312. The maintenance control portion 124 controls the execution of maintenance performed by the maintenance portion 24 on the basis of the determination result of the maintenance determination portion 314. In addition, the maintenance system 300 of the present embodiment is configured to further include a job management portion 316 and an output portion 318 that outputs the progress status or the like of a job to the display portion 108, in order to make it easier to ascertain the progress status of a job.

The ejection states of the ink jet heads 56C, 56M, 56Y, and 56K are detected on the basis of an image which is read using the scanner 60. That is, the ejection states of the ink jet heads 56C, 56M, 56Y, and 56K are detected by printing a predetermined test chart, reading the image using the scanner 60, and analyzing the read image. The analysis of an image is performed by the system controller 100. The system controller 100 executes a required image analysis program, and thus functions as an image analysis portion 310A that analyzes an image which is read using the scanner 60.

Therefore, in the ink jet recording device 10 of the present embodiment, the scanner 60 and the system controller 100 constitute an ejection state detection portion 310 in combination with each other.

In addition, the control of this ejection state detection portion 130 is performed by the system controller 100. The system controller 100 executes a predetermined control program, and thus functions as an ejection state detection control portion 320 that controls the ejection state detection portion 310.

The detection of the ejection state is performed with respect to, for example, the presence or absence of a non-ejection nozzle, the ejection direction curvature amount of an individual nozzle, the amount of ejection (dot size) of an individual nozzle, and the like.

Meanwhile, the detection of the ejection state can be performed every time one piece of paper is printed, and can also be performed in units of jobs. In a case where the ejection state is detected every time one piece of paper is printed, a test chart is printed in the margin region (region in which an image is not drawn) of paper. In a case where the detection is performed in units of jobs, a test chart is printed using the entire paper, in addition to a configuration in which a test chart is printed in the margin region of paper. In a case where more detailed detection is performed, it is preferable to print a test chart using the entire paper. On the other hand, it is possible to detect the ejection state in real time by detecting the ejection state every time one piece of paper is printed using the margin region.

The ejection abnormality level determination portion 312 determines the degree of ejection abnormality (ejection abnormality level) of the ink jet heads 56C, 56M, 56Y, and 56K from the detection results of the ejection state detection portion 310. The determination is performed with reference to an ejection abnormality level determination criterion which is set in advance. That is, the ejection abnormality level determination portion 312 determines the ejection abnormality level from the detection results of ejection abnormality, in the light of the determination criterion (ejection abnormality level determination criterion) which is set in advance.

The ejection abnormality level determination criterion used in the determination is set in view of a risk of generating an image quality defect. Normally, as the ejection state becomes worse, there is a higher risk of generating an image quality defect. That is, since a risk of generating an image quality defect changes in accordance with the ejection state, the level of ejection abnormality is set in accordance with a risk of generating an image quality defect. For example, in a case where the ejection abnormality level is set to four levels, a case where ejection abnormality is not present and a risk of generating an image quality defect is not present can be set to a level A, a case where a risk of generating an image quality defect is present in several job destinations can be set to a level B, a case where a risk of generating an image quality defect is present can be set to a level C, and a case where an image quality defect has already been generated can be set to a level D. The ejection abnormality levels are summarized as follows.

Level A: a risk of generating an image quality defect is not present

Level B: a risk of generating an image quality defect is present in several job destinations Level C: a risk of generating an image quality defect is present Level D: an image quality defect occurs Meanwhile, a relationship between the ejection state and the risk of generating an image quality defect is obtained in advance by, for example, experiment, simulation or the like. The ejection abnormality level determination criterion is set from the obtained relationship.

Information of the ejection abnormality level determination criterion which is set is stored in the storage portion 104. The ejection abnormality level determination portion 312 refers to the ejection abnormality level determination criterion stored in the storage portion 104, and determines the ejection abnormality levels of the ink jet heads 56C, 56M, 56Y, and 56K from the detection results of the ejection state detection portion 310.

The maintenance determination portion 314 determines the necessity of maintenance from the determination result of the ejection abnormality level determination portion 312, and further determines the type in a case of execution.

The necessity of maintenance is determined with reference to the maintenance execution criterion which is set in advance. That is, in a case where the ejection abnormality level determined by the ejection abnormality level determination portion 312 satisfies the maintenance execution criterion which is set in advance, maintenance is determined to be required. For example, as described above, in a case where the ejection abnormality level is divided into four levels of the level A to the level D, it is assumed that the maintenance execution criterion is set to the level B. In this case, except for a case where the ejection abnormality level is the level A, maintenance is determined to be required in all of the levels. Therefore, in this case, the maintenance execution criterion is set as follows.

Maintenance execution criterion: execution of maintenance in levels where the ejection abnormality level is equal to or higher than the level B Information of the maintenance execution criterion is stored in the storage portion 104. The maintenance determination portion 314 refers to the maintenance execution criterion stored in the storage portion 104, and determines the necessity of the maintenance of the ink jet heads 56C, 56M, 56Y, and 56K from the determination result of the ejection abnormality level determination portion 312.

In a case where maintenance is executed, the type of maintenance to be executed is determined with reference to the maintenance level determination criterion which is set in advance. The maintenance level determination criterion is set in accordance with the ejection abnormality level. That is, as the ejection abnormality level becomes higher, the determination criterion is set so that maintenance having higher recovery capability is executed.

As described above, in the ink jet recording device 10 of the present embodiment, three of preliminary ejection, wiping, and purging are prepared as the maintenance of the ink jet heads 56C, 56M, 56Y, and 56K. The recovery capability increases in the order of preliminary ejection, wiping, and purging.

For example, as described above, in a case where the ejection abnormality level is set to four stages of the levels A to D, the type of maintenance can be set as follows.

Level A: no maintenance

Level B: preliminary ejection

Level C: wiping

Level D: purging

In this case, the following settings are made: maintenance is not performed in the level A, preliminary ejection is performed in the level B, wiping is performed in the level C, and purging is performed in the level D.

Meanwhile, a relationship between the ejection state and the risk of generating ab image quality defect is obtained in advance by, for example, experiment, simulation or the like. The ejection abnormality level determination criterion is set from the obtained relationship.

Information of the maintenance level determination criterion is stored in the storage portion 104. The maintenance determination portion 314 refers to the maintenance level determination criterion stored in the storage portion 104, and determines the type of maintenance from the determination result of the ejection abnormality level determination portion 312.

The maintenance control portion 124 controls the maintenance portion 24 and controls the execution of maintenance, on the basis of the determination result of the maintenance determination portion 314.

Incidentally, the maintenance of the ink jet heads 56C, 56M, 56Y, and 56K is performed between the jobs. That is, the maintenance is performed after a job is terminated and before the next job is executed. Therefore, the detection of the ejection state is performed before the next job is executed, and the determination of the necessity of maintenance is also performed before the next job is executed. For this reason, the management of a job is required.

The job management portion 316 manages jobs. That is, the management is performed so that a plurality of jobs received are executed in the order of reception. The job management portion 316 is realized by the system controller 100 executing a required job management program. In addition, the job management portion 316 creates a job management table having the contents of jobs recorded therein and manages a plurality of jobs. The job management table is stored in the storage portion 104.

The output portion 318 outputs acquired information of jobs and information of the progress statuses of the jobs to the display portion 108 in accordance with a predetermined display format, on the basis of information of the jobs recorded in the job management table. In this case, information of the execution status of maintenance is output together therewith.

Figure 10:
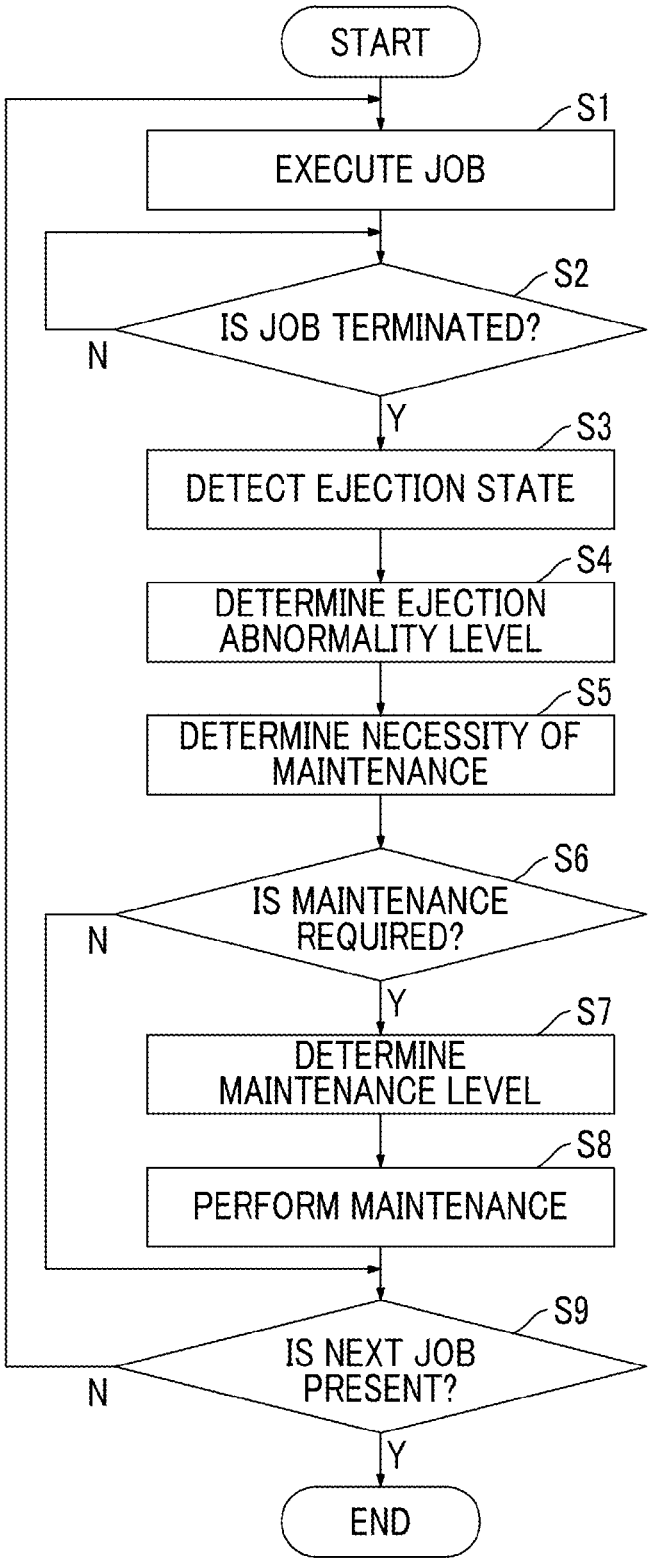
FIG. 10 is a flow diagram illustrating an operation procedure of maintenance performed by the maintenance system.

FIG. 10 is a flow diagram illustrating an operation procedure of maintenance performed by the maintenance system.

As described above, in the ink jet recording device 10, a plurality of jobs can be received continuously, and the plurality of jobs received are sequentially processed in the order of reception.

First, an initial job which is one job within the plurality of jobs is executed (step S1). Next, it is determined whether the job has been terminated (step S2).

When the job is terminated, the ejection states of the ink jet heads 56C, 56M, 56Y, and 56K are detected by the ejection state detection control portion 320 (step S3). Here, a predetermined test chart is printed, and the ejection states are detected from the printing results. The system controller 100 functioning as the ejection state detection control portion 320 causes the ink jet heads 56C, 56M, 56Y, and 56K to print a test chart, and causes the scanner 60 to read the printing results. The read results (image data of the printed test chart) are analyzed, and the ejection states of the ink jet heads 56C, 56M, 56Y, and 56K are detected.

Next, an ejection abnormality level is determined on the basis of the detection results of the ejection states (step S4). The system controller 100 functioning as the ejection abnormality level determination portion 312 refers to the ejection abnormality level determination criterion stored in the storage portion 104, and determines the ejection abnormality levels of the ink jet heads 56C, 56M, 56Y, and 56K from the detection results of the ejection state detection portion 310.

Next, the necessity of maintenance is determined on the basis of the determination result of the ejection abnormality level (step S5). The system controller 100 functioning as the maintenance determination portion 314 refers to the maintenance execution criterion stored in the storage portion 104, and determines the necessity of the maintenance of the ink jet heads 56C, 56M, 56Y, and 56K from the determination result of the ejection abnormality level determination portion 312.

Next, the necessity of maintenance is determined on the basis of the determination result of the necessity of maintenance (step S6).

When maintenance is determined not to be required, the presence or absence of the next job is determined (step S9). When the next job is determined to be present, the next job is executed (step S1). When the next job is determined not to be present, the process is terminated.

On the other hand, when maintenance is determined to be required, the maintenance level is determined (step S7). The system controller 100 functioning as the maintenance determination portion 314 refers to the maintenance level determination criterion stored in the storage portion 104, and determines the type of maintenance from the determination result of the ejection abnormality level. The maintenance control portion 124 is caused to execute the determined type of maintenance (step S8).

After the maintenance is terminated, the presence or absence of the next job is determined (step S9). In a case where the next job is present, the next job is executed (step S1). In a case where the next job is not present, the process is terminated.

In this manner, in the ink jet recording device 10 of the present embodiment, the ejection states of the ink jet heads 56C, 56M, 56Y, and 56K are detected for each job, the ejection abnormality levels of the ink jet heads 56C, 56M, 56Y, and 56K are determined from the detection results, and the necessity of the maintenance of the ink jet heads 56C, 56M, 56Y, and 56K is determined on the basis of the determined ejection abnormality levels. In a case where maintenance is required, maintenance is performed before the next job is executed. In a case where maintenance is not required, the next job is executed continuously. Thereby, it is possible to insert the maintenance of the ink jet heads 56C, 56M, 56Y, and 56K between appropriately jobs, and to process the jobs efficiently. In addition, thereby, it is possible to extend the life span of the ink jet heads 56C, 56M, 56Y, and 56K.

Modification Example

Modification Example 1

The ejection states of the ink jet heads 56C, 56M, 56Y, and 56K can be detected for each ink jet head. Therefore, the necessity of maintenance is determined for each ink jet head, and thus it is also possible to set to the type of maintenance. Thereby, it is possible to appropriately maintain each of the ink jet heads 56C, 56M, 56Y, and 56K. In addition, the life span of each of the ink jet heads 56C, 56M, 56Y, and 56K is also further extended.

In addition, a configuration can be used in which the same maintenance is performed collectively. In this case, for example, maintenance is performed in accordance with an ink jet head having a lowest ejection abnormality level. For example, in a case where the ejection abnormality level of the ink jet head 56C of cyan is B, the ejection abnormality level of the ink jet head 56M of magenta is A, the ejection abnormality level of the ink jet head 56Y of yellow is A, and the ejection abnormality level of the ink jet head 56K of black is A, maintenance according to the ejection abnormality level B of the ink jet head 56C of cyan is performed on all the ink jet heads.

Meanwhile, the ink jet recording device of the present embodiment is configured such that all the ink jet heads move to the maintenance portion 24 collectively, but may be configured such that the ink jet heads move to the maintenance portion individually. In this case, only an ink jet head which is a target of maintenance can be moved to the maintenance portion and be maintained.

Modification Example 2

In the ink jet recording device 10 of the present embodiment, the ink jet head is configured to have a plurality of head modules engaged with each other. In this case, a configuration can also be used in which maintenance is executed in units of head modules. That is, a configuration can also be used in which the ejection state is detected in units of head modules, the necessity of maintenance is determined in units of head modules, and maintenance is executed in units of head modules. Thereby, it is more appropriately maintain the ink jet head. In addition, it is also possible to extend the life span of the entire ink jet head.

Meanwhile, in this case, the maintenance portion is required to be configured to be capable of executing multiple types of maintenance in units of head modules. In a case where maintenance is performed in units of head modules, for example, preliminary ejection is executed only with respect to a corresponding head module. Similarly, purging is also executed only with respect to a corresponding head module. In addition, wiping is performed in accordance with a timing at which a corresponding head module passes through the wiping device 160. That is, the web W is brought into contact with the nozzle surface of a corresponding head module. Thereby, it is possible to selectively perform maintenance in units of head modules.

Modification Example 3

In the above embodiment, there is a configuration of determining the necessity of maintenance on the basis of the maintenance execution criterion which is set in advance. This maintenance execution criterion may be able to be corrected.

The maintenance is performed in order to constantly maintain the ejection state of the ink jet head and to maintain the performance of the ink jet recording device, but the frequent execution thereof gives rise to a problem of the process of a job being delayed.

On the other hand, the quality of an image requested by a user is not constant at all times, and differs depending on the contents or the like of printed matter. For example, in a case where a commercial poster is printed, and a case where a printed matter of only characters is printed, the required qualities of an image are different from each other. The execution of maintenance on the same criterion as for a commercial poster in a case where printed matter of only characters is printed interferes with the progress of a job on the contrary.

Therefore, it is preferable to be capable of correcting the maintenance execution criterion. That is, it is preferable to be capable of appropriately correcting a standard setting which is set in advance. In this case, a configuration can be used in which correction is performed by a user, and a configuration can also be used in which automatic correction is performed.

In a case where a user corrects the maintenance execution criterion, a configuration can be used in which the correction thereof is performed, for example, using the operating portion 106 and the display portion 108. That is, a configuration can be used in which the correction screen of the maintenance execution criterion is displayed on the display portion 108 through the operating portion 106, and the maintenance execution criterion is corrected on the basis of its screen information. For example, there is a configuration of displaying the current setting of the maintenance execution criterion, and to input instructions for raising or dropping a level at which maintenance is executed, from the operating portion 106. In this case, the operating portion 106 and the display portion 108 function as a maintenance execution criterion correction portion.

In addition, in a case where the maintenance execution criterion is automatically corrected, it is possible to adopt a method of performing the correction on the basis of image quality required for an image to be printed, a method of performing the correction on the basis of the type of image to be printed, a method of performing the correction on the basis of the type of paper to be used, a method of performing the correction depending on the operating mode of the ink jet recording device, a method of performing the correction depending on the processing time of a job to be processed next, and the like. Hereinafter, a case where the maintenance execution criterion is automatically corrected will be described.

[Case where Maintenance Execution Criterion is Corrected on the Basis of Image Quality Required for Image to be Printed]

In a case where the maintenance execution criterion is automatically corrected on the basis of image quality required for an image to be printed, information of the required image quality is acquired, and the maintenance execution criterion is corrected in accordance with a correction criterion which is set in advance. That is, the maintenance execution criterion which is set in standard is corrected in accordance with the required image quality. For example, in a case where a standard setting is made so that maintenance is executed in the level C or higher, an increase in the required image quality causes the maintenance execution criterion to be corrected so that maintenance is executed in the level B or higher. Reversely, a decrease in the required image quality causes the maintenance execution criterion to be corrected so that maintenance is executed in the level D or higher.

The correction criterion is set by determining the maintenance execution criterion to be newly set for each required image quality. In this case, as described above, the correction criterion is set so that, as the required image quality increases, the maintenance execution criterion to be newly set decreases. For example, in a case where the required image quality is divided into standard, high quality, and low quality, the correction criterion can be set as follows.

Standard setting: execution of maintenance in the ejection abnormality level C or higher Case where the required image quality is standard: no correction Case where the required image quality is high: execution of maintenance in the ejection abnormality level B or higher Case where the required image quality is low: execution of maintenance in the ejection abnormality level D or higher The set correction criterion is stored in the storage portion 104.

The quality of an image to be printed is specified by a user, for example, during the order of jobs. That is, the information of the image quality is input to the ink jet recording device 10 in a state where the information is included in the job. Alternatively, the quality of an image to be printed is pointed out using the operating portion 106 and the display portion 108 of the ink jet recording device 10. For example, a configuration is used in which the image qualities (such as high quality, standard, and low quality) capable of being selected are displayed as a list on the display portion 108, and are selected using the operating portion 106.

The system controller 100 functions as an image quality information acquisition portion by executing a predetermined program, and acquires the information of the image quality required for an image to be printed, from information included in a job. Alternatively, the information of the image quality pointed out using the operating portion 106 and the display portion 108 is acquired.

The system controller 100 functions as the maintenance execution criterion correction portion by executing a predetermined program, and refers to the correction criterion on the basis of the acquired information of the image quality to determine the maintenance execution criterion to be set. The system controller 100 corrects the maintenance execution criterion as necessary. That is, the system controller 100 corrects the maintenance execution criterion to a maintenance execution criterion consistent with the required image quality.

[Case where Maintenance Execution Criterion is Corrected on the Basis of Type of Image to be Printed]

In a case where the maintenance execution criterion is automatically corrected on the basis of the type of image to be printed, information of the type of image to be printed (image type information) is acquired, and the maintenance execution criterion is corrected in accordance with the correction criterion which is set in advance. That is, the maintenance execution criterion which is set in standard is corrected in accordance with the type of image to be printed. For example, in a case where a standard setting is made so that maintenance is executed in the level C or higher, the maintenance execution criterion is corrected so that maintenance is executed in the level B or higher in the image type in which the required image quality is high. Reversely, the maintenance execution criterion is corrected so that maintenance is executed in the level D or higher in the image type in which the high image quality is not required.

The correction criterion is set by determining the maintenance execution criterion to be newly set for each type of image. The type of image is an image type such as, for example, a poster, a photograph, or a character. In this case, for example, the correction criterion is set as follows.

Standard setting: execution of maintenance in the ejection abnormality level C or higher Poster: execution of maintenance in the ejection abnormality level B or higher Photograph: execution of maintenance in the ejection abnormality level B or higher Character: execution of maintenance in the ejection abnormality level D or higher The set correction criterion is stored in the storage portion 104.

The type of image to be printed is specified by a user, for example, during the order of jobs. That is, information of the image type is input to the ink jet recording device 10 in a state where the information is included in the job. Alternatively. The image type is pointed out using the operating portion 106 and the display portion 108 of the ink jet recording device 10. For example, a configuration is used in which the image types capable of being selected are displayed as a list on the display portion 108, and are selected using the operating portion 106.

The system controller 100 functions as an image type information acquisition portion by executing a predetermined program, and acquires the image type information from information included in a job. Alternatively, the information of the image type pointed out using the operating portion 106 and the display portion 108 is acquired.

The system controller 100 functions as the maintenance execution criterion correction portion by executing a predetermined program, and refers to the correction criterion on the basis of the acquired image type information to determine the maintenance execution criterion to be set. The system controller 100 corrects the maintenance execution criterion as necessary. That is, the system controller 100 corrects the maintenance execution criterion to a maintenance execution criterion according to the type of image to be printed.

[Case where Maintenance Execution Criterion is Corrected on the Basis of Type of Paper to be Used]

In a case where the maintenance execution criterion is automatically corrected on the basis of the type of paper (media) to be used (paper type (media type)), information of the type of paper to be used (paper type information (media type information)) is acquired, and the maintenance execution criterion is corrected in accordance with the correction criterion which is set in advance. That is, the maintenance execution criterion which is set in standard is corrected in accordance with the type of paper to be used. For example, in a case where a standard setting is made so that maintenance is executed in the level C or higher, paper in which an image defect has a tendency to occur (paper in which an image defect has a tendency to be conspicuous) has the maintenance execution criterion corrected so that maintenance is executed in the level B or higher. Reversely, paper in which an image defect is not likely to occur has the maintenance execution criterion corrected so that maintenance is executed in the level D or higher.

The correction criterion is set by determining the maintenance execution criterion to be newly set for each paper type. The set correction criterion is stored in the storage portion 104.

The paper type is specified by a user, for example, during the order of jobs. That is, information of the paper type is input to the ink jet recording device 10 in a state where the information is included in the job. Alternatively, the paper type is pointed out using the operating portion 106 and the display portion 108 of the ink jet recording device 10. For example, a configuration is used in which the paper types are displayed as a list on the display portion 108, and are selected using the operating portion 106.

The system controller 100 functions as a paper type information acquisition portion (media type information acquisition portion) by executing a predetermined program, and acquires the information of the image quality required for an image to be printed, from information included in a job. Alternatively, the information of the paper type pointed out using the operating portion 106 and the display portion 108 is acquired.

The system controller 100 functions as the maintenance execution criterion correction portion by executing a predetermined program, and refers to the correction criterion on the basis of the acquired paper type information to determine the maintenance execution criterion to be set. The system controller 100 corrects the maintenance execution criterion as necessary. That is, the system controller 100 corrects the maintenance execution criterion to a maintenance execution criterion according to the type of paper to be used.

The types of paper can also be classified into size, paper thickness and the like, in addition to the paper type. That is, in a case where even the same types of paper differ in paper thickness or size from each other, the maintenance execution criterion can also be changed in different types of paper.

[Case where Maintenance Execution Criterion is Corrected in Accordance with Operating Mode of Ink Jet Recording Device]

In a case where the maintenance execution criterion is corrected in accordance with the operating mode of the ink jet recording device, the correction criterion which is set in advance is referred to, and the maintenance execution criterion is corrected in accordance with the set operating mode. That is, the maintenance execution criterion which is set in standard is corrected in accordance with the set operating mode.

For example, in a case where a standard mode, an image quality priority mode, and a time priority mode can be set as the operating mode, the maintenance execution criterion is corrected in a case where the image quality priority mode and the time priority mode are set. In this case, in a case where the image quality priority mode is set, the maintenance execution criterion is lowered. That is, the maintenance execution criterion is corrected so that maintenance is executed even in a case where the ejection abnormality level is low. Thereby, it is possible to maintain the ejection state satisfactorily at all times. On the other hand, in a case where the time priority mode is set, the maintenance execution criterion is raised. That is, the maintenance execution criterion is corrected so that maintenance is not executed even in a case where the ejection abnormality level is slightly high. Thereby, it is possible to process a job efficiently.

The correction criterion is set by determining the maintenance execution criterion to be newly set for each settable mode. For example, in a case where the standard mode, the image quality priority mode, and the time priority mode are prepared as the operating mode, the correction criterion can be set as follows.

Standard setting: execution of maintenance in the ejection abnormality level C or higher Standard mode: no correction of the maintenance execution criterion Image quality priority mode: execution of maintenance in the ejection abnormality level B or higher Time priority mode: execution of maintenance in the ejection abnormality level D or higher The set correction criterion is stored in the storage portion 104.

The setting of the operating mode is performed using, for example, the operating portion 106 and the display portion 108 of the ink jet recording device 10. For example, a configuration is used in which operating modes capable of being selected are displayed as a list on the display portion 108, and are selected using the operating portion 106. In this case, the operating portion 106 and the display portion 108 function as a mode setting portion.

Besides, a configuration can also be used in which the operating mode is set during the order of jobs. That is, a configuration can also be used in which the jobs are ordered inclusive of information of the operating mode. In this case, a host computer functions as the mode setting portion.

The system controller 100 functions as the maintenance execution criterion correction portion by executing a predetermined program, and refers to the correction criterion on the basis of the set operating mode to determine the maintenance execution criterion to be set. The system controller 100 corrects the maintenance execution criterion as necessary. That is, the system controller 100 corrects the maintenance execution criterion to a maintenance execution criterion according to the operating mode.

[Case where Maintenance Execution Criterion is Corrected on the Basis of Processing Time of Job to be Processed Next]

In a case where the maintenance execution criterion is automatically corrected on the basis of the processing time of a job to be processed next to the current job, the correction criterion which is set in advance is referred to, and the maintenance execution criterion is corrected in accordance with the processing time of the job to be processed next. That is, the maintenance execution criterion which is set in standard is corrected in accordance with the length of the processing time of the job to be processed next.

For example, in a case where the processing time of the job to be processed next becomes longer than the processing time which is set in standard, the maintenance execution criterion is lowered. That is, the maintenance execution criterion is corrected so that maintenance is executed even in a case where the ejection abnormality level is low. On the other hand, in a case where the processing time of the job to be processed next becomes shorter than the processing time which is set in standard, the maintenance execution criterion is raised. That is, the maintenance execution criterion is corrected so that maintenance is not executed even in a case where the ejection abnormality level is slightly high.

The correction criterion is set by dividing the processing time of a job into a plurality of divisions, and determining the maintenance execution criterion to be newly for each division. For example, in a case where the division of the processing time of a job is divided into standard, short which is shorter in processing time than standard, and long which is longer in processing time than standard, the correction criterion can be set as follows.

Standard setting: execution of maintenance in the ejection abnormality level C or higher Standard: no correction of the maintenance execution criterion Long: execution of maintenance in the ejection abnormality level B or higher Short: execution of maintenance in the ejection abnormality level D or higher The set correction criterion is stored in the storage portion 104.

The processing time of a job (job processing time) can be obtained from information of a printing speed (the number of sheets to be printed per unit time) and information of the number of sheets to be printed in one job. Since the information of a printing speed has already been known, the system controller 100 can calculate the job processing time from the known information of a printing speed and the received information of the number of sheets to be printed in the job. The system controller 100 functions as a job processing time calculation portion that calculates the job processing time by executing a predetermined control program.

In addition, the system controller 100 functions as the maintenance execution criterion correction portion by executing a predetermined program, and refers to the correction criterion on the basis of the calculated job processing time to determine the maintenance execution criterion to be set. The system controller 100 corrects the maintenance execution criterion as necessary. That is, the system controller 100 corrects the maintenance execution criterion to a maintenance execution criterion according to the processing time of the job to be processed next.

Modification Example 4

In the above embodiment, in a case where maintenance is executed, a configuration is used in which the type of maintenance is determined on the basis of the maintenance level determination criterion. The maintenance level determination criterion may also be able to be corrected similarly to the maintenance execution criterion. Such correction of the maintenance level determination criterion may be performed independently, and may be performed together with the correction of the maintenance execution criterion.

A configuration can be used in which the maintenance level determination criterion is corrected by a user, and a configuration can also be used in which the maintenance level determination criterion is corrected automatically.

In a case where a user corrects the maintenance level determination criterion, a configuration can be used in which the correction thereof is performed, for example, using the operating portion 106 and the display portion 108. That is, a configuration can be used in which the correction screen of the maintenance level determination criterion is displayed on the display portion 108 through the operating portion 106, and the maintenance level determination criterion is corrected in the operating portion 106 on the basis of its screen information. For example, there is a configuration of displaying the maintenance level determination criterion which is set currently (contents of maintenance which are set for each ejection abnormality level) on the display portion 108, and to perform the correction thereof using the operating portion 106. In this case, the operating portion 106 and the display portion 108 function as a maintenance level determination criterion correction portion.

In addition, in a case where the maintenance level determination criterion is corrected automatically, similarly to the correction of the maintenance execution criterion, it is possible to adopt a method of performing the correction on the basis of image quality required for an image to be printed, a method of performing the correction on the basis of the type of image to be printed, a method of performing the correction on the basis of the type of paper to be used, a method of performing the correction depending on the operating mode of the ink jet recording device, a method of performing the correction depending on the processing time of a job to be processed next, and the like.

[Case where Maintenance Level Determination Criterion is Corrected on the Basis of Image Quality Required for Image to be Printed]

In a case where the maintenance level determination criterion is automatically corrected on the basis of the image quality required for an image to be printed, the information of the required image quality is acquired, and the maintenance level determination criterion is corrected in accordance with the correction criterion which is set in advance. That is, the maintenance level determination criterion which is set in standard is corrected in accordance with the required image quality.

The correction criterion is set by determining the maintenance level determination criterion to be newly set for each required image quality. In this case, for example, in a case where the required image quality becomes higher, the setting is made by determining the correction criterion so that maintenance having high recovery capability is executed even in a low ejection abnormality level. For example, in a case where the required image quality is divided into standard, high quality and low quality, the correction criterion can be set as follows.

Case where the required image quality is standard
Ejection abnormality level A: no maintenance
Ejection abnormality level B: preliminary ejection
Ejection abnormality level C: wiping (normal)
Ejection abnormality level D: purging
Case where the required image quality is high quality
Ejection abnormality level A: no maintenance
Ejection abnormality level B: wiping (normal)
Ejection abnormality level C: reciprocating wiping
Ejection abnormality level D: purging
Case where the required image quality is low quality
Ejection abnormality level A: no maintenance
Ejection abnormality level B: no maintenance
Ejection abnormality level C: wiping (normal)
Ejection abnormality level D: purging Herein, the reciprocating wiping refers to a wiping method in which the ink jet head is reciprocated and wiped. On the other hand, the normal wiping refers to a wiping method in which the ink jet head is moved in one direction and wiped. In the reciprocating wiping, since the nozzle surface is wiped out two times and is wiped out even from the reverse direction, the recovery capability of the ejection state increase. However, the processing time increases to two times.

The set correction criterion is stored in the storage portion 104.

The quality of an image to be print is specified by a user, for example, during the order of jobs. That is, the information of the image quality is input by a user to the ink jet recording device 10 in a state where the information is included in the job. Alternatively, the quality of an image to be printed is pointed out by a user using the operating portion 106 and the display portion 108 of the ink jet recording device 10. For example, a configuration is used in which the image qualities (such as high quality, standard, and low quality) capable of being selected are displayed as a list on the display portion 108, and are selected by a user using the operating portion 106.

The system controller 100 functions as the image quality information acquisition portion by executing a predetermined program, and acquires the information of the image quality required for an image to be printed, from information included in a job. Alternatively, the information of the image quality pointed out using the operating portion 106 and the display portion 108 is acquired.

The system controller 100 functions as the maintenance level determination criterion correction portion by executing a predetermined program, and refers to the correction criterion on the basis of the acquired information of the image quality to determine the maintenance level determination criterion to be set. The system controller 100 corrects the maintenance level determination criterion as necessary. That is, the system controller 100 corrects the maintenance level determination criterion to a maintenance level determination criterion consistent with the required image quality.

[Case where Maintenance Level Determination Criterion is Corrected on the Basis of Type of Image to be Printed]

In a case where the maintenance level determination criterion is automatically corrected on the basis of the type of image to be printed, information of the type of image to be printed (image type information) is acquired, and the maintenance level determination criterion is corrected in accordance with the correction criterion which is set in advance. That is, the maintenance level determination criterion which is set in standard is corrected in accordance with the type of image to be printed.

The correction criterion is set by determining the maintenance level determination criterion to be newly set for each type of image. For example, in a case where the image type is a poster and a character, the correction criterion is, for example, as follows.

Standard Setting
Ejection abnormality level A: no maintenance
Ejection abnormality level B: preliminary ejection
Ejection abnormality level C: wiping (normal)
Ejection abnormality level D: purging
Image type: poster
Ejection abnormality level A: no maintenance
Ejection abnormality level B: wiping (normal)
Ejection abnormality level C: reciprocating wiping
Ejection abnormality level D: purging
Image type: character
Ejection abnormality level A: no maintenance
Ejection abnormality level B: no maintenance
Ejection abnormality level C: wiping (normal)
Ejection abnormality level D: purging The set correction criterion is stored in the storage portion 104.

The type of image to be printed is specified by a user, for example, during the order of jobs. Alternatively, the image type is pointed out using the operating portion 106 and the display portion 108 of the ink jet recording device 10.

The system controller 100 functions as the image type information acquisition portion by executing a predetermined program, and acquires the image type information from information included in a job. Alternatively, the system controller 100 acquires the information of the image type pointed out using the operating portion 106 and the display portion 108.

The system controller 100 functions as the maintenance level determination criterion correction portion by executing a predetermined program, and refers to the correction criterion on the basis of the acquired image type information to determine the maintenance level determination criterion to be set. The system controller 100 corrects the maintenance level determination criterion as necessary. That is, the system controller 100 corrects the maintenance level determination criterion to a maintenance level determination criterion according to the type of image to be printed.

[Case where Maintenance Level Determination Criterion is Corrected on the Basis of Type of Paper to be Used]

In a case where the maintenance level determination criterion is automatically corrected on the basis of the type of paper (media) to be used (paper type (media type)), information of the type of paper to be used (paper type information (media type information)) is acquired, and the maintenance level determination criterion is corrected in accordance with the correction criterion which is set in advance. That is, the maintenance level determination criterion which is set in standard is corrected in accordance with the type of paper to be used.

The correction criterion is set by determining the maintenance level determination criterion to be newly set for each paper type. The set correction criterion is stored in the storage portion 104.

The paper type is specified by a user, for example, during the order of jobs. That is, information of the paper type is input by a user to the ink jet recording device 10 in a state where the information is included in the job. Alternatively, the paper type is pointed out by a user using the operating portion 106 and the display portion 108 of the ink jet recording device 10. For example, a configuration is used in which the paper types are displayed as a list on the display portion 108, and are selected by a user using the operating portion 106.

The system controller 100 functions as the paper type information acquisition portion by executing a predetermined program, and acquires the information of the image quality required for an image to be printed, from information included in a job. Alternatively, the system controller 100 acquires the information of the paper type pointed out by a user using the operating portion 106 and the display portion 108.

The system controller 100 functions as the maintenance level determination criterion correction portion by executing a predetermined program, and refers to the correction criterion on the basis of the acquired paper type information to determine the maintenance level determination criterion to be set. The system controller 100 corrects the maintenance level determination criterion as necessary. That is, the system controller 100 corrects the maintenance level determination criterion to a maintenance level determination criterion according to the type of paper to be used.

The types of paper can also be classified into size, paper thickness and the like, in addition to the paper type.

[Case where Maintenance Level Determination Criterion is Corrected in Accordance with Operating Mode of Ink Jet Recording Device]

In a case where the maintenance level determination criterion is corrected in accordance with the operating mode of the ink jet recording device, the maintenance level determination criterion is corrected in accordance with the set operating mode.

For example, in a case where a standard mode, an image quality priority mode, and a time priority mode can be set as the operating mode, the maintenance level determination criterion is corrected in a case where the image quality priority mode and the time priority mode are set. In this case, in a case where the image quality priority mode is set, the maintenance level determination criterion is corrected so that maintenance having high recovery capability is executed even in a low ejection abnormality level. On the other hand, in a case where the time priority mode is set, the maintenance level determination criterion is corrected so that maintenance is omitted even when the ejection abnormality level is slightly high, or maintenance (that is, maintenance having a short processing time) having low recovery capability is executed.

The correction criterion is set by determining the maintenance level determination criterion to be newly set for each settable mode. For example, in a case where the standard mode, the image quality priority mode, and the time priority mode are prepared as the operating mode, the correction criterion can be set as follows.

Standard Setting
Ejection abnormality level A: no maintenance
Ejection abnormality level B: preliminary ejection
Ejection abnormality level C: wiping (normal)
Ejection abnormality level D: purging
Operating mode: standard mode
No correction of maintenance level determination criterion
Operating mode: image quality priority mode
Ejection abnormality level A: no maintenance
Ejection abnormality level B: wiping (normal)
Ejection abnormality level C: reciprocating wiping
Ejection abnormality level D: purging
Operating mode: time priority mode
Ejection abnormality level A: no maintenance
Ejection abnormality level B: no maintenance
Ejection abnormality level C: wiping (normal)
Ejection abnormality level D: purging The set correction criterion is stored in the storage portion 104.

The setting of the operating mode is performed using, for example, the operating portion 106 and the display portion 108 of the ink jet recording device 10. In this case, the operating portion 106 and the display portion 108 function as the mode setting portion.

Besides, a configuration can also be used in which the operating mode is set during the order of jobs. That is, a configuration can also be used in which the jobs are ordered inclusive of information of the operating mode. In this case, a host computer functions as the mode setting portion.

The system controller 100 functions as the maintenance level determination criterion correction portion by executing a predetermined program, and refers to the correction criterion on the basis of the set operating mode to determine the maintenance level determination criterion to be set. The system controller 100 corrects the maintenance level determination criterion as necessary. That is, the system controller 100 corrects the maintenance level determination criterion to a maintenance level determination criterion according to the operating mode.

[Case where Maintenance Level Determination Criterion is Automatically Corrected on the Basis of Processing Time of Job to be Processed Next]

In a case where the maintenance level determination criterion is automatically corrected on the basis of the processing time of a job to be processed next to the current job, the correction criterion which is set in advance is referred to, and the maintenance level determination criterion is corrected in accordance with the processing time of the job to be processed next. That is, the maintenance level determination criterion which is set in standard is corrected in accordance with the length of the processing time of the job to be processed next.

For example, in a case where the processing time of the job to be processed next becomes longer than the processing time which is set in standard, the maintenance level determination criterion is corrected so that maintenance having high recovery capability is executed even in a low ejection abnormality level. On the other hand, in a case where the processing time of the job to be processed next becomes shorter than the processing time which is set in standard, the maintenance level determination criterion is corrected so that maintenance is omitted even when the ejection abnormality level is slightly high, or maintenance having low recovery capability (that is, maintenance having a short processing time) is executed.

The correction criterion is set by dividing the processing time of a job into a plurality of divisions, and determining the maintenance level determination criterion to be newly for each division. For example, in a case where the division of the processing time of a job is divided into standard, short which is shorter in processing time than standard, and long which is longer in processing time than standard, the correction criterion can be set as follows.

Standard Setting

Ejection abnormality level A: no maintenance

Ejection abnormality level B: preliminary ejection

Ejection abnormality level C: wiping (normal)

Ejection abnormality level D: purging

Processing time of the next job: standard

No correction of the maintenance level determination criterion

Processing time of the next job: long

Ejection abnormality level A: no maintenance

Ejection abnormality level B: wiping (normal)

Ejection abnormality level C: reciprocating wiping

Ejection abnormality level D: purging

Processing time of the next job: short

Ejection abnormality level A: no maintenance

Ejection abnormality level B: no maintenance

Ejection abnormality level C: wiping (normal)

Ejection abnormality level D: purging

The set correction criterion is stored in the storage portion 104.

The system controller 100 calculates the job processing time from the known information of a printing speed and the received information of the number of sheets to be printed in the job.

The system controller 100 functions as the maintenance level determination criterion correction portion by executing a predetermined program, and refers to the correction criterion on the basis of the calculated processing time of the job to determine the maintenance level determination criterion to be set. The maintenance level determination criterion is corrected as necessary. That is, the maintenance level determination criterion is corrected to a maintenance level determination criterion according to the processing time of the job to be processed next.

Modification Example 5

A configuration can also be used in which the maintenance execution criterion and/or the maintenance determination criterion is automatically corrected in accordance with the length of an operation stoppage time inserted between a plurality of jobs. That is, in a case where the operation stoppage time inserted between the plurality of jobs becomes longer, the maintenance execution criterion is corrected so that maintenance is performed even in a case where the ejection abnormality level is low. Alternatively, in a case where the operation stoppage time inserted between the plurality of jobs becomes longer, the maintenance level determination criterion is corrected so that maintenance having high recovery capability (that is, maintenance having along processing time) is performed even in a case where the ejection abnormality level is low.

In a case where the plurality of jobs are accumulated, the jobs are processed sequentially, but operations are temporarily stopped between the respective jobs. Normally, this stoppage time is substantially constant. However, in a case where the replenishment or replacement of paper and the replenishment or replacement of ink are required, the work is performed between the jobs. Therefore, in a case where the work is performed, the operation is stopped for a long period of time. Therefore, in a case where the operation for a long period of time is stopped in this manner, the maintenance execution criterion is corrected, and thus maintenance is preferentially performed. Alternatively, maintenance having high recovery capability is preferentially performed.

It is possible to know the necessity of the replenishment or replacement of paper and the necessity of the replenishment or replacement of ink in advance. That is, regarding the necessity of the replenishment of paper, it is possible to know at what timing the paper is to be replenished by managing the remaining amount of the paper and the job. In addition, it is possible to know the necessity of the replacement of paper from the received contents of the job. Similarly, regarding the necessity of the replenishment of ink, it is possible to know at what timing the ink is to be replenished by managing the remaining amount of the ink and the job. In addition, it is possible to know the necessity of the replacement of ink from the receiving contents of the job.

In addition, since the replenishment work of paper is performed in a set procedure, the minimum time required for the work can be known in advance. Similarly, the minimum time required for the replacement of paper, the minimum time required for the replenishment of ink, and the minimum time required for the replacement of ink can also be known in advance. Therefore, the minimum time required for each work is managed using a table, and thus it is possible to know the operation stoppage time inserted between the jobs from information of work contents inserted between the respective jobs.

The system controller 100 acquires information of the replenishment or replacement work of paper inserted between the jobs, and/or information (work information) of the replenishment or replacement work of ink, refers to a table in which work contents and information of a time required for the work are associated with each other, calculates the operation stoppage time inserted between the jobs, and corrects the maintenance execution criterion and/or the maintenance level determination criterion, on the basis of the calculated operation stoppage time.

In this case, the table in which the work contents and the information of a time required for the work are associated with each other is stored in the storage portion 104 in advance.

In addition, the system controller 100 executes a predetermined management program, to thereby manage the jobs, manage the remaining amount of paper and the remaining amount of ink, and manage the timings of the replenishment or replacement of paper and the replenishment or replacement of ink. Therefore, the system controller 100 functions as a work management portion that manages the replenishment or replacement work of paper and/or the replenishment or replacement work of ink, and functions as a work information acquisition portion that acquires these pieces of work information (information of the replenishment or replacement work of paper inserted between the jobs, and/or information of the replenishment or replacement work of ink).

In addition, the system controller 100 functions as an operation stoppage time calculation portion that refers to the table in which the work contents and the information of a time required for the work are associated with each other, and calculates the operation stoppage time inserted between the jobs on the basis of the acquired work information.

Further, the system controller 100 functions as an operation stoppage time information acquisition portion that acquires information of the calculated operation stoppage time, and acquires information of the operation stoppage time inserted between the jobs.

These functions are realized by the predetermined system controller 100 executing a predetermined control program.

<<Other Examples of Maintenance>>

In the above embodiment, three of preliminary ejection, wiping, and purging are illustrated as the maintenance of the ink jet head, but the maintenance of the ink jet head is not limited thereto.

Besides, for example, it can be considered that the replacement of the ink jet head is also one of the maintenances. In addition, in the case of an ink jet head configured to have a plurality of head modules engaged with each other as in the ink jet head of the present embodiment, it can be considered that the replacement of the head module is also one of the maintenances. Further, it can be considered that cleaning of the flow channel of the ink jet head with an exclusive cleaning liquid is also one of the maintenances.

In addition, regarding the wiping, a configuration is also used in which wiping is performed with a web in the present example, it is also possible to configure an aspect in which wiping is performed using a blade, and to configure an aspect in which a rotating pad is pressed against the nozzle surface to perform wiping.

Further, it is also possible to change recovery capability by changing the number of times of wiping. Normally, as the number of times of wiping is increased, the recovery capability becomes higher. For example, reciprocating wiping is higher in recovery capability than only one-time wiping. However, the processing time of maintenance becomes longer to that extent.

Generally, regarding the maintenance, as the recovery capability of the ejection state increases, a time required for processing becomes longer. Generally, a procedure required for processing increases in the order of preliminary ejection<wiping<purging<flow channel cleaning<head replacement.

<<Other Examples of Method of Detecting Ejection State>>

In the above embodiment, a configuration is used in which the ejection state of the ink jet head is detected from the detection result of a test chart, but a method of detecting the ejection state of the ink jet head is not limited thereto.

Besides, for example, a configuration can also be used in which the nozzle surface of the ink jet head is imaged using imaging means such as a CCD camera for imaging the nozzle surface, and the ejection state of the ink jet head is detected on the basis of the obtained image of the nozzle surface. That is, it is also possible to detect the ejection state of the ink jet head using a method of ascertaining the contamination state of the nozzle surface from the image of the nozzle surface, and estimating the ejection state.

In this case, it can also be configured to imaging the nozzle surface by receiving infrared light. In this case, a light source may be configured to perform irradiation with only infrared light through a filter, and may be configured to perform irradiation with light including visible light and infrared light. By imaging the nozzle surface using infrared light, it is possible to ascertain the contamination state of the inside portion of the nozzle, and to detect the ejection state more appropriately.

In a case where the nozzle surface of the ink jet head is imaged using the imaging means in this manner, and the ejection state of the ink jet head is detected, for example, the imaging means is installed on the movement path of the ink jet heads 56C, 56M, 56Y, and 56K moving between the drawing position and the standby position. Thereby, it is also possible to image the nozzle surface in the ink jet recording device using the long ink jet heads 56C, 56M, 56Y, and 56K.

Meanwhile, in the above embodiment, a configuration is used in which the ejection state of the ink jet head is detected after the termination of the job, but a configuration can also be used in which the ejection state of the ink jet head is detected during the execution of the job. For example, in a case where a margin region is present in an image to be printed, a test chart is printed in the margin region, thereby allowing the ejection state of the ink jet head to be detected even during the job.

<<Management of Progress of Job>>

As described above, the ink jet recording device 10 is configured to receive a plurality of jobs at any time, and to sequentially process the jobs in the order of reception. In this case, the ability for a user to ascertain the progress status (processing status) of the jobs can allow the convenience of the ink jet recording device 10 to be further improved. Consequently, information of the acquired jobs and information of the progress status of the jobs are output to the display portion 108 in a predetermined format, and thus a user can ascertain the progress status (processing status) of the jobs. Hereinafter, the progress management of the jobs will be described.

Figure 11A:
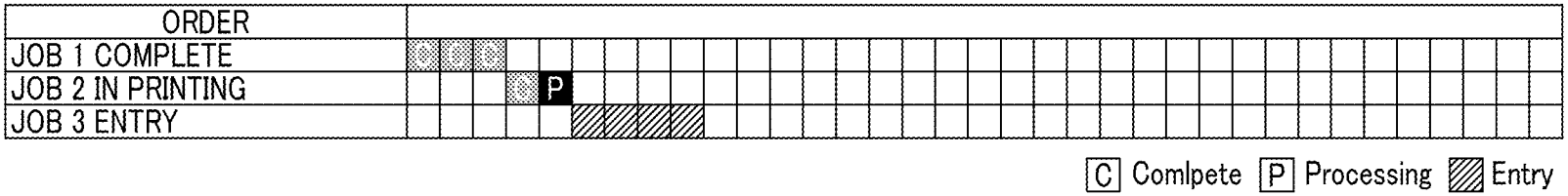
FIG. 11A is a diagram illustrating a display example of the progress status of a job on a display portion.
Figure 11B:
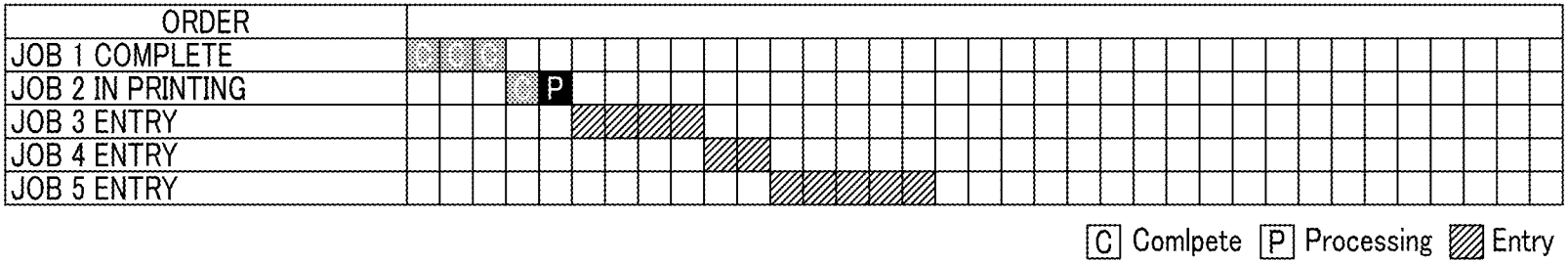
FIG. 11B is a diagram illustrating a display example of the progress status of the job on the display portion.

FIGS. 11A and 11B are diagrams illustrating display examples of the progress status of a job on the display portion. Meanwhile, FIG. 11A is a diagram illustrating a display example during a printing operation, and FIG. 11B is a diagram illustrating a display example in a case where a job is added.

In the example shown in the same drawings, there is a configuration of displaying columns of items indicating jobs acquired in a longitudinal direction and "squares" indicating the progress status in a lateral direction, and to display information of the acquired jobs and information of the progress status of the jobs.

When jobs are received, items of the jobs are sequentially added and displayed below an item of an existing job. In addition, squares indicating the progress status of the jobs are developed and displayed laterally to the column of the added item of the job. FIG. 11A shows a state where three jobs are received. In addition, FIG. 11B shows a state where two jobs are added. In this case, an item of a job 4 is added below an item of a job 3, and an item of a job 5 is further added below the item of the job 4.

The contents and state of a job are displayed in the column of the item of the job. In the example shown in FIG. 11A, it is shown that a job 1 is complete, a job 2 is in printing, and the job 3 is in entry (in reception).

In the squares indicating the progress status, one square indicates a unit time, and the squares of time regions occupied by each job in a time-series order are displayed in color. In the example shown in FIG. 11A, execution in the order of the job 1, the job 2, and the job 3 can be ascertained from the display. In addition, a rough time required for each job can be ascertained from the number of squares displayed in color. In the example shown in FIG. 11A, since the job 1 holds three squares, the job 2 holds two squares, and the job 3 holds four squares, it is possible to ascertain that it takes the most time to process the job 3, from the display.

In addition, regarding processing completion, an icon ("C") of "Complete" is displayed in a square. From the display of FIG. 11A, it is possible to ascertain that the job 1 is complete, and the job 2 is halfway complete.

Further, regarding in-processing, an icon ("P") of "Processing" is displayed in a square. From the display of FIG. 11B, it is possible to ascertain that the job 2 is in processing.

FIGS. 11A and 11B are an example of display, but such display is displayed on the display portion 108, and thus a user can easily ascertain the progress status (processing status) of the job.

Meanwhile, a process required for display is performed by the system controller 100 executing a predetermined control program. That is, the system controller 100 functions as the output portion 318 that outputs the information of the acquired job and the information of the progress status of the job to the display portion 108 in a predetermined format.

In addition, as shown in FIGS. 11A and 11B, in a case where a time occupied by one job is displayed by the number of squares, it is necessary to acquire information of a time required for processing the job. As described above, the time required for processing one job can be obtained from information of a printing speed (the number of sheets to be printed per unit time) in the ink jet recording device 10 and information of the number of sheets to be printed in one job.

In addition, as described above, since the information of the operation stoppage time inserted between a plurality of jobs can also be acquired, it is further preferable that a time which will be taken until a plurality of acquired jobs are all terminated is calculated from this information of the operation stoppage time (operation stoppage time information) and information of the job processing time which is a time required for processing each job, and is output to the display portion 108 as the remaining time.

In this case, the system controller 100 functions as a remaining time calculation portion by executing a predetermined control program, and calculates a time (remaining time) which will be taken until all the jobs are terminated from the information of the job processing time and the information of the operation stoppage time to output the calculated time to the display portion 108.

Modification Example: Management of Progress of Job Inclusive of Maintenance

In the examples shown in FIGS. 11A and 11B, a configuration is used in which only the information of the acquired job and the information of the progress status of the job are displayed, but the entire management is further facilitated by displaying information of the detection results of the ejection state and information of the execution status of maintenance.

Hereinafter, a display example of the detection results of the ejection state, and the information of the progress status of the job including the execution status of maintenance will be described.

Meanwhile, herein, the ejection abnormality level is assumed to be determined by the following criterion (ejection abnormality level determination criterion).

No ejection abnormality: level A
Degree of ejection abnormality (1): level B
Degree of ejection abnormality (2): level C
Degree of ejection abnormality (3): level D
Degree of ejection abnormality (4): level E Meanwhile, as the numerical value of the degree of ejection abnormality becomes larger, the degree is assumed to be severe (the possibility of occurrence of an image defect is high).

In addition, the necessity of maintenance is assumed to be determined by the following criterion (maintenance execution criterion). That is, maintenance is assumed to be performed in the ejection abnormality level equal to or higher than the level D.

Further, the type of maintenance to be executed is assumed to be determined by the following criterion (maintenance level determination criterion).

Ejection abnormality level A: no maintenance
Ejection abnormality level B: preliminary ejection
Ejection abnormality level C: wiping (normal wiping)
Ejection abnormality level D: reciprocating wiping
Ejection abnormality level E: purging The recovery capability of the ejection state increases in the order of preliminary ejection, normal wiping, reciprocating wiping, and purging. In this case, the recovery capability of the preliminary ejection is lowest, and the recovery capability of the purging is highest. On the other hand, a time required for maintenance increases in the order of preliminary ejection, normal wiping, reciprocating wiping, and purging. In this case, a time required for the preliminary ejection is shortest, and a time required for the purging is longest.

In addition, in the present example, the detection of the ejection state is assumed to be performed during the execution of the job. In this case, a test chart is printed in the margin region of paper, and the ejection state of the ink jet head is detected every time one piece of paper is printed.

FIGS. 12A to 12I are transition diagrams of display examples of the detection results of the ejection state, and the information of the progress status of jobs including the execution status of maintenance.

Figure 12A:
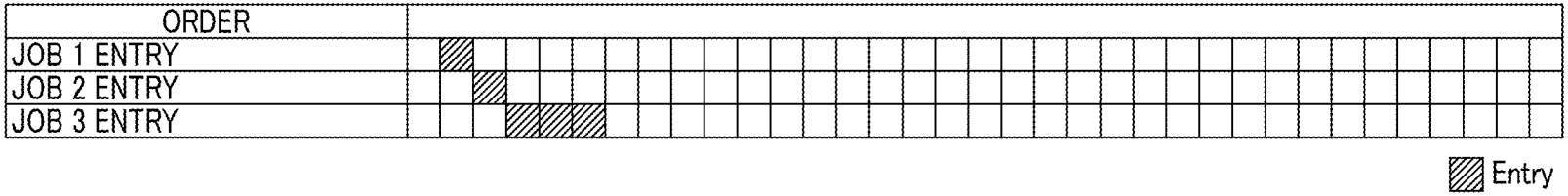
FIG. 12A is a transition diagram of a display example of information of the progress status of the job.

FIG. 12A is a display example when jobs are received. In the example shown in the same drawing, a state where three jobs are received is shown. The jobs are set to a job 1, a job 2, a job 3, . . . in the order of reception, and are processed in the order of reception.

Figure 12B:
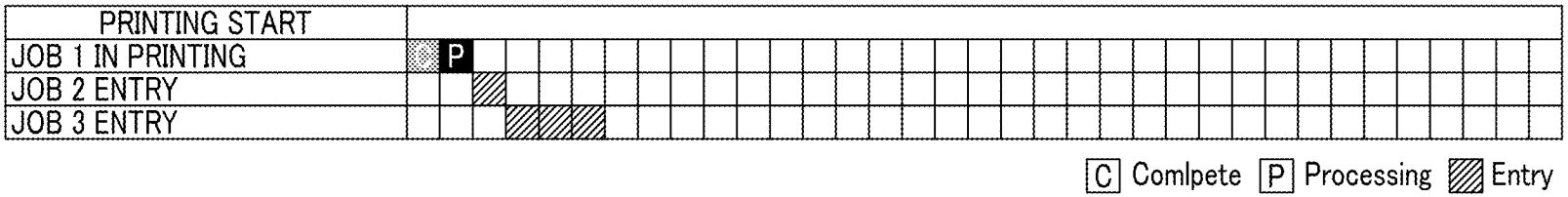
FIG. 12B is a transition diagram of a display example of information of the progress status of the job.

FIG. 12B is a display example during the execution of the job 1. An icon of "Processing" is displayed in the square of processing during execution. According to FIG. 12B, it is possible to ascertain that the job 1 is in execution. In addition, an icon of "Complete" is displayed in a complete square. According to FIG. 12B, it is possible to ascertain that half of the job 1 has already been complete.

Figure 12C:
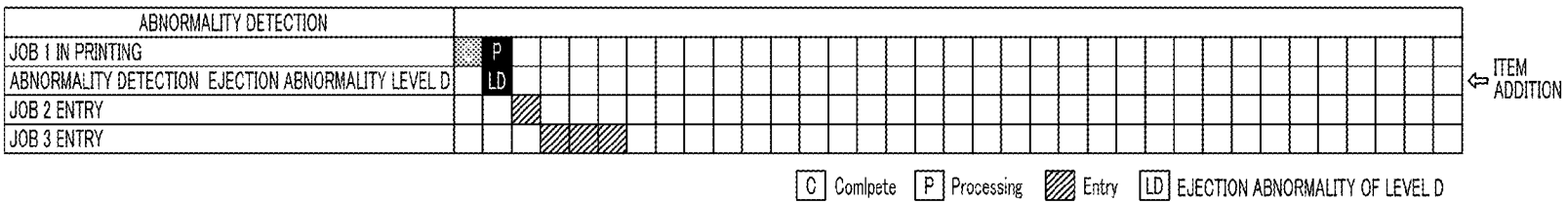
FIG. 12C is a transition diagram of a display example of information of the progress status of the job.

FIG. 12C is a display example when ejection abnormality during the execution of the job 1 is detected. In this case, an item of abnormality detection is added and displayed between an item of the job 1 and an item of the job 2. The determined ejection abnormality level is displayed in this added item of abnormality detection. In addition, an icon ("LX": X is a determined level (B to E)) of the determined "ejection abnormality level" is displayed in the square of a time region where abnormality is detected. In the example shown in the same drawing, it is shown that ejection abnormality of the level D is detected.

As described above, in the ink jet recording device of the present example, maintenance is performed in the level D or higher. Therefore, in this case, maintenance is determined to be required, and the maintenance is executed. According to the aforementioned maintenance level determination criterion, maintenance performed in the level D is reciprocating wiping. Therefore, in this case, reciprocating wiping is performed after the termination of the job 1.

Figure 12D:
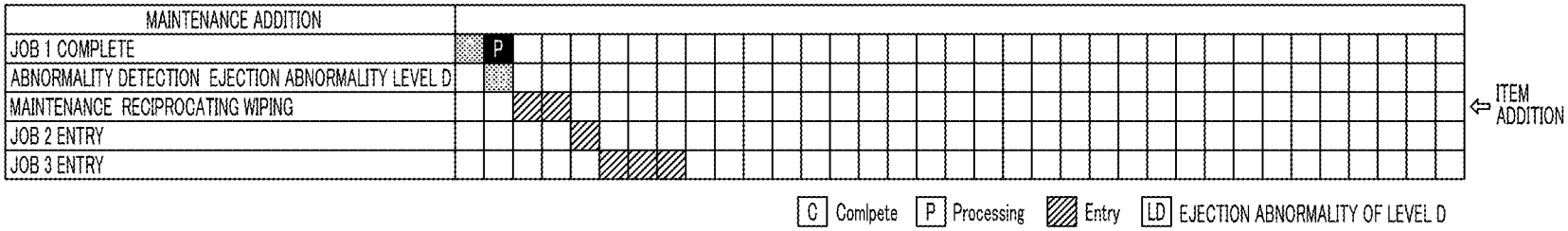
FIG. 12D is a transition diagram of a display example of information of the progress status of the job.

FIG. 12D is a display example in a case where maintenance is determined to be required. As shown in the same drawing, an item of maintenance is added and displayed before the job 2. The contents of maintenance are displayed together in this item of maintenance to be performed. In the example shown in the same drawing, it is shown that reciprocating wiping is performed. Thereby, it is possible to ascertain the execution of maintenance and the contents of the maintenance.

Meanwhile, as described above, one square indicates a unit time, and thus the number of squares indicates a time required for processing. In the example shown in FIG. 12D, it is possible to ascertain that two squares' worth of processing time is required for the reciprocating wiping.

Figure 12E:
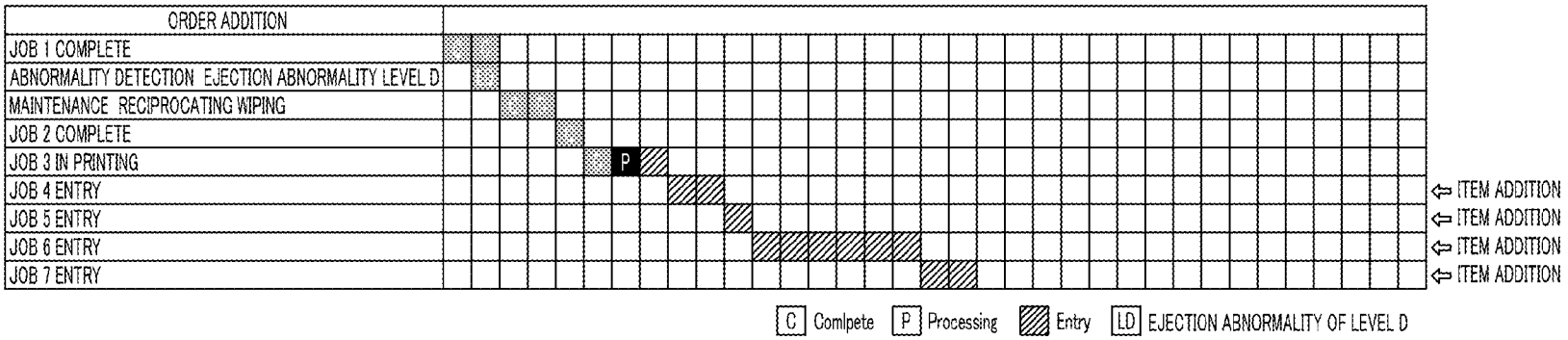
FIG. 12E is a transition diagram of a display example of information of the progress status of the job.

FIG. 12E is a display example in a case where jobs are added. In a case where jobs are added, items of new jobs are added below the existing item. In the example shown in the same drawing, it is shown that new four jobs (jobs 4, 5, 6, and 7) are newly added during the execution of the job 3.

Figure 12F:
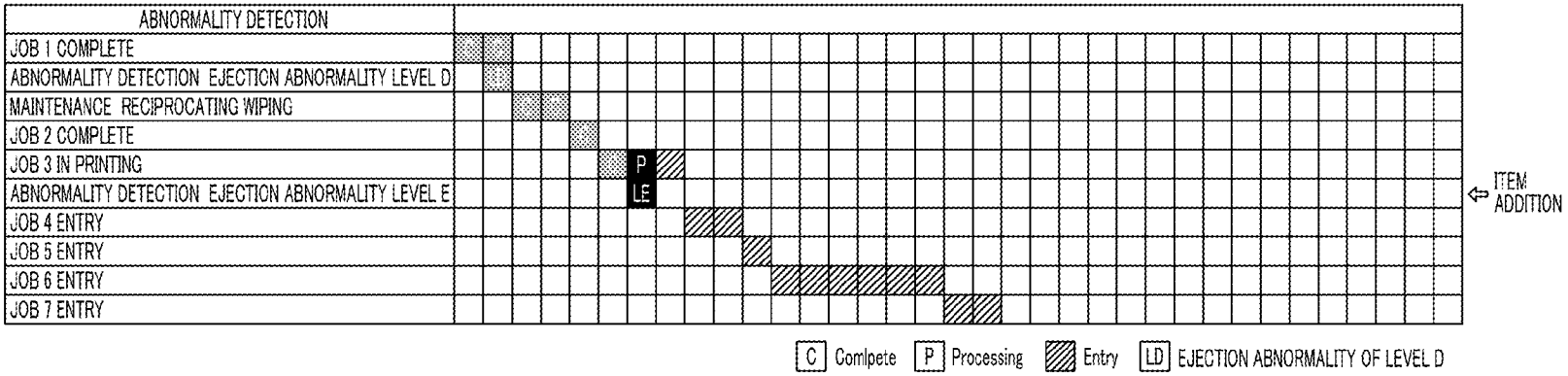
FIG. 12F is a transition diagram of a display example of information of the progress status of the job.

FIG. 12F is a display example when ejection abnormality during the execution of the job 3 is detected. In this case, an item of abnormality detection is added and displayed between the item of the job 3 and the item of the job 4. A determined ejection abnormality level is displayed in this added item of abnormality detection. In addition, an icon of the determined "ejection abnormality level" is displayed in the square of a time region where abnormality is detected. In the example shown in the same drawing, it is shown that ejection abnormality of the level E is detected.

As described above, in the ink jet recording device of the present example, maintenance is performed in the level D or higher. Therefore, in this case, maintenance is determined to be required, and the maintenance is executed. According to the aforementioned maintenance level determination criterion, maintenance which is performed in the level E is purging. Therefore, in this case, purging is performed after the termination of the job 3.

Figure 12G:
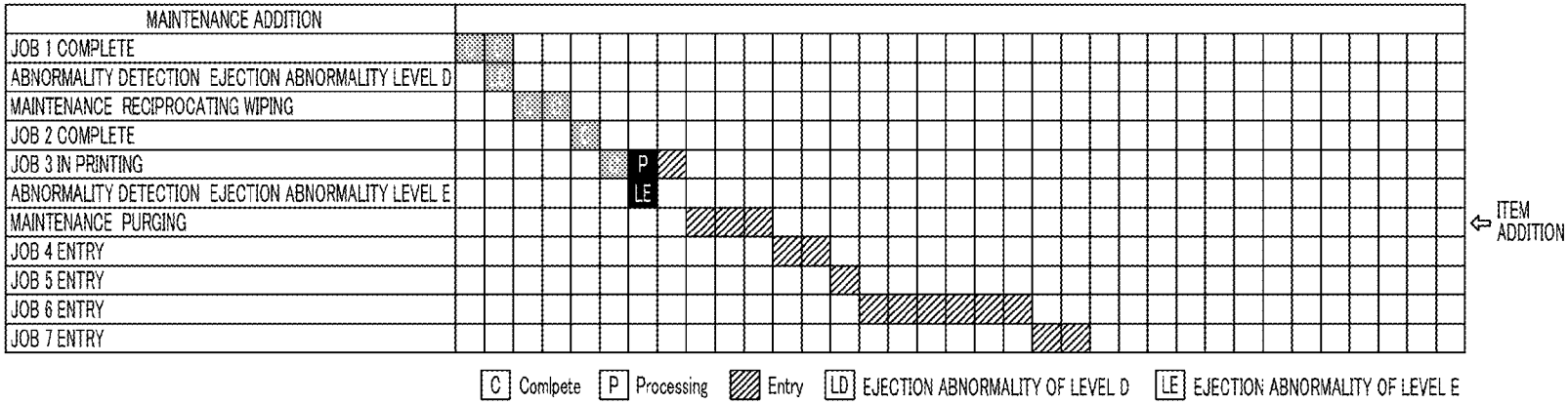
FIG. 12G is a transition diagram of a display example of information of the progress status of the job.

FIG. 12G is a display example in a case where maintenance is determined to be required. As shown in the same drawing, an item of maintenance is added and displayed before the job 4. In the example shown in the same drawing, it is shown that purging is performed.

Figure 12H:
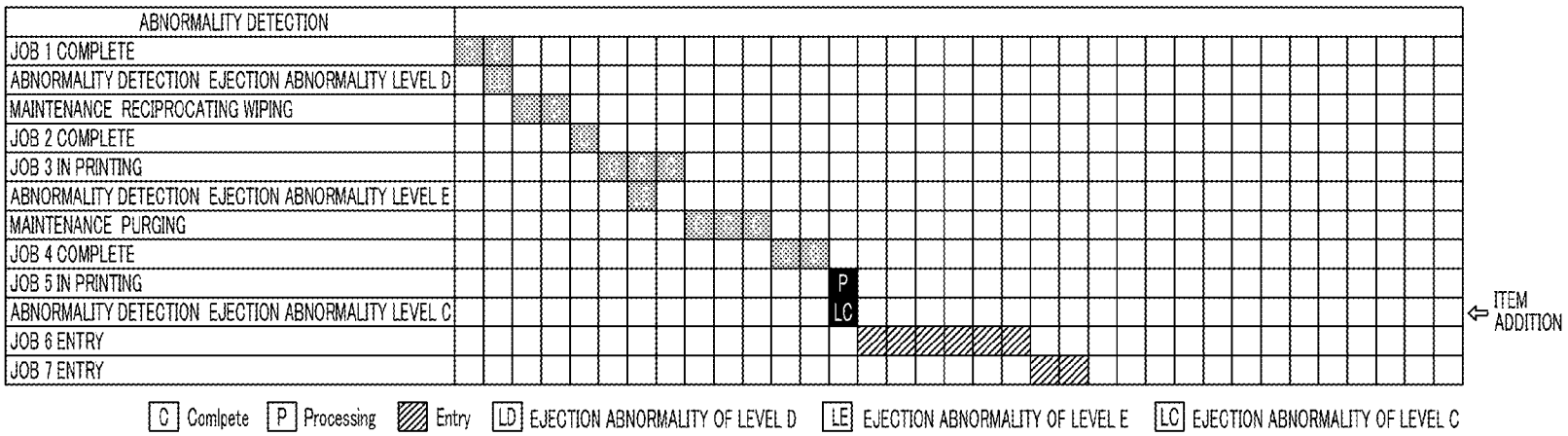
FIG. 12H is a transition diagram of a display example of information of the progress status of the job.

FIG. 12H is a display example when processing of jobs progresses, and ejection abnormality during the execution of the job 5 is detected. In this case, an item of abnormality detection is added and displayed between an item of the job 5 and an item of the job 6. A determined ejection abnormality level is displayed in this added item of abnormality detection. In addition, an icon of the determined "ejection abnormality level" is displayed in the square of a time region where abnormality is detected. In the example shown in the same drawing, it is shown that ejection abnormality of the level C is detected.

Figure 12I:
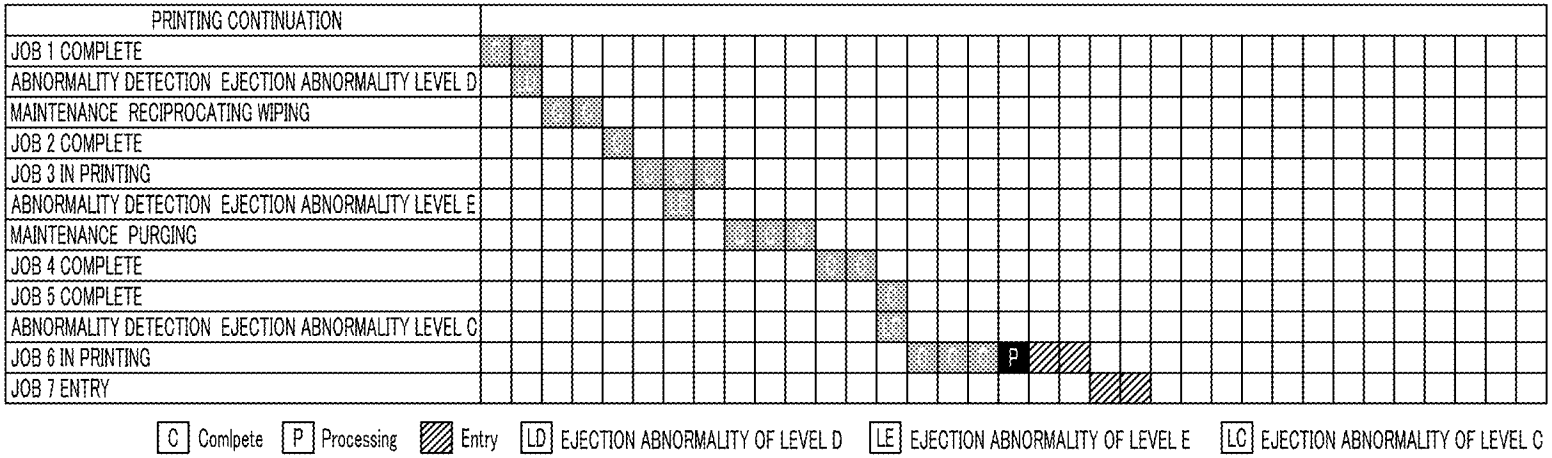
FIG. 12I is a transition diagram of a display example of information of the progress status of the job.

As described above, in the ink jet recording device of the present example, maintenance is performed in the level D or higher. Therefore, in this case, maintenance is determined not to be required, and the maintenance is omitted. Therefore, as shown in FIG. 12I, the job 6 is executed after the completion of the job 5.

In this manner, information of the detection results of the ejection state and information of the execution status of maintenance are displayed in addition to the information of the acquired job and the information of the progress status of the job, and thus the entire management is further facilitated.

Meanwhile, in the above example, there is a configuration of executing maintenance in levels where the ejection abnormality level is equal to or higher than the level D. This is an example of a so-called time priority mode, and is configured such that processing of jobs is preferentially executed even in a case where some ejection abnormality occurs.

Figure 13:
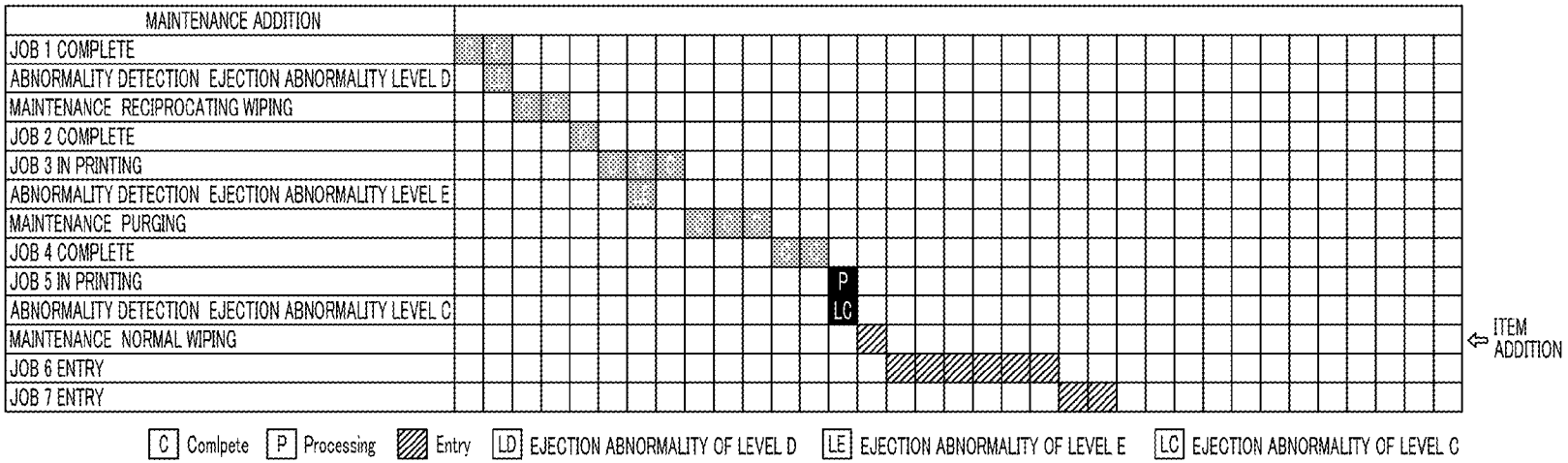
FIG. 13 is a transition diagram of a display example of information of the progress status of the job.

In the image quality priority mode, for example, there is a configuration of executing maintenance in levels where the ejection abnormality level is equal to or higher than the level B. Therefore, in this case, when ejection abnormality of the level C is detected during the execution of the job 5 (case of FIG. 12I), maintenance is determined to be required before the execution of the job 6. FIG. 13 is a display example in a case where maintenance is determined to be required. As shown in the same drawing, an item of maintenance is added and displayed before the job 6. In the example shown in the same drawing, it is shown that normal wiping is performed.

In addition, in a case where maintenance is performed in consideration of the operation stoppage time between the jobs, maintenance is executed when the operation stoppage time exceeds a certain period of time. For example, in the above example, there is no job after the job 7, and thus an operation is stopped after the job 7. Therefore, in such a case, maintenance is performed after the job 7.

Figure 14:
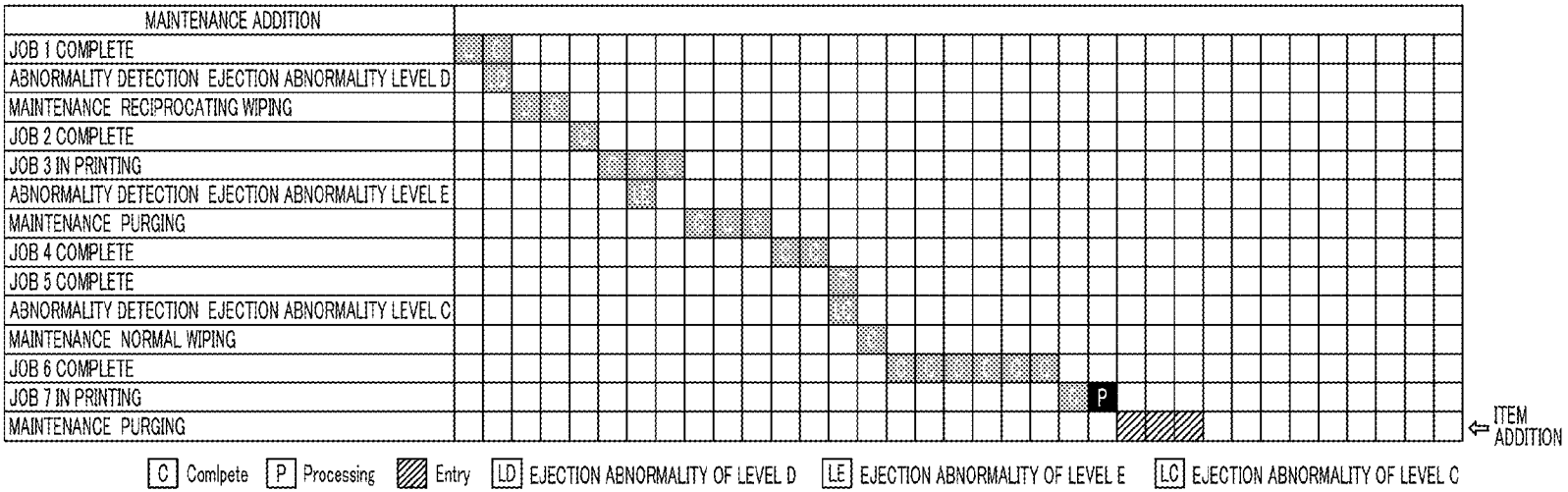
FIG. 14 is a transition diagram of a display example of information of the progress status of the job.

FIG. 14 is a display example in a case where there is no job to be executed after a job in execution. As shown in the same drawing, an item of maintenance is added and displayed after the job 7 in execution. In this case, the type of maintenance to be executed can be determined in accordance with the length of a time at which an operation is stopped. For example, purging is executed when purging is possible during operation stop, and normal wiping is executed when only normal wiping is possible. That is, maintenance having as high a recovery capability as possible is executed during an idle time.

Meanwhile, in a case where above a certain operation stoppage time occurs, it can also be configured to uniformly execute constant maintenance.

Other Embodiments

<Combination with Periodic Maintenance>

Generally, the maintenance of the ink jet head is periodically performed in accordance with a fixed rule. That is, maintenance is performed, for example, under a rule of executing predetermined maintenance when a certain number of sheets are printed from the previous maintenance, executing predetermined maintenance when a certain period of time has elapsed from the previous maintenance, executing predetermined maintenance during the startup of the device, executing predetermined maintenance during the stop of the device (during power-off), and the like.

The maintenance system of the present embodiment can also be used in combination with such periodic maintenance. For example, the periodic maintenance can also be forcibly performed. That is, even in a case where maintenance is determined not to be required in the maintenance execution criterion, it can also be configured to preferentially perform the periodic maintenance at a timing at which the maintenance is performed.

In addition, an operation can also be performed using only the maintenance system of the present embodiment by a change to the periodic maintenance. Further, it is also possible to select an operation based on the periodic maintenance and an operation based on the maintenance system of the present embodiment.

<Operation Based on Server Device>

In a case where the ink jet recording device 10 is connected to a server device through a network, and the ink jet recording device 10 can be remotely controlled by the server device, the maintenance system can also be realized by the server device. That is, the functions of the ejection abnormality level determination portion 312, the maintenance determination portion 314, and the maintenance control portion 124 can also be realized by the server device. Similarly, the job management portion 316 that manages the progress status or the like of jobs, the output portion 318, and the like can also be realized by the server device.

EXPLANATION OF REFERENCES

10: ink jet recording device
12: paper feed portion
14: treatment liquid coating portion
16: treatment liquid drying portion
18: drawing portion
20: post-processing portion
20A: ink drying portion
20B: ultraviolet irradiation portion
22: paper discharge portion
24: maintenance portion
30: paper feed stand
32: sucker device
34: paper feed roller pair
36: feeder board
38: front stop
40: paper feed drum
40A: gripper
42: treatment liquid coating drum
42A: gripper
44: treatment liquid coating device
46: treatment liquid drying drum
46A: gripper
48: paper guide
50: treatment liquid drying unit
52: drawing drum
52A: gripper
54: paper pressing roller
56 (56C, 56M, 56Y, 56K): ink jet head
56-*i*(56-1, 56-2, . . . ): head module
57: nozzle surface
57A: nozzle array region
58: bar frame
60: scanner
64: chain gripper
64A: chain
64B: gripper
68: dryer
72: guide plate
74: ultraviolet irradiation device
76: paper discharge stand
100: system controller
102: communication portion
104: storage portion
106: operating portion
108: display portion
110: transport control portion
112: paper feed control portion
114: treatment liquid coating control portion
116: treatment liquid drying control portion
118: drawing control portion
120A: ink drying control portion
120B: ultraviolet irradiation control portion
122: paper discharge control portion
124: maintenance control portion
138: head moving device
140: head mounting frame
140*a*: head mounting frame body
140*b*: head mounting portion
140*c*: head support portion
142: head mounting frame moving device
146: guide rail
147: slider
148: feeding device
148A: screw rod
148B: nut member
148C: motor
154: waste liquid tray
156: cap unit
158: wiping unit
160 (160C, 160M, 160Y, 160K): wiping device
161: body frame
162: supply reel
163: winding reel
164: web driving motor
165: pressing roller
166: guide member
167: cleaning liquid supply nozzle
168: elevation device
200 (200C, 200M, 200Y, 200K): cap
202: entrance portion
206: moisturizing liquid storage portion
206A: partition plate
208: moisturizing liquid supply portion
210: drain portion
214: moisturizing liquid supply port
216: moisturizing liquid supply tube
218: drain hole
222: seal member
300: maintenance system
310: ejection state detection portion
310A: image analysis portion
312: ejection abnormality level determination portion

314: maintenance determination portion
316: job management portion
318: output portion
320: ejection state detection control portion
P: paper
N: nozzle
W: web

What is claimed is:

1. A maintenance system of an ink jet recording device, including an ejection state detection portion that detects an ejection state of an ink jet head and a maintenance portion that maintains the ink jet head, which acquires a job relevant to image recording and sequentially executes the job, the maintenance system comprising:

an ejection state detection control portion that controls the ejection state detection portion to detect the ejection state of the ink jet head during execution of the job or after the execution thereof;

an ejection abnormality level determination portion that refers to an ejection abnormality level determination criterion which is set in advance, and determines an ejection abnormality level of the ink jet head on the basis of a detection result of the ejection state of the ink jet head obtained by the ejection state detection control portion;

a maintenance determination portion that refers to a maintenance execution criterion which is set in advance, and determines whether the ink jet head is required to be maintained after the execution of the job having the ejection state detected therein and before execution of the next job, on the basis of a determination result of the ejection abnormality level determination portion;

a maintenance control portion that controls the maintenance portion to maintain the ink jet head, on the basis of a determination result of the maintenance determination portion;

a maintenance execution criterion correction portion that corrects the maintenance execution criterion;

an operation stoppage time information acquisition portion that acquires information of an operation stoppage time inserted between the plurality of jobs; and an output portion that outputs information of a plurality of acquired jobs and information of a progress status of the plurality of jobs, wherein the maintenance portion is configured to be capable of executing multiple types of maintenance having different capabilities of recovering the ejection state, the maintenance determination portion refers to a maintenance level determination criterion which is set in advance, and further determines a type of maintenance to be executed, on the basis of the determination result of the ejection abnormality level determination portion, and the maintenance execution criterion correction portion corrects the maintenance execution criterion on the basis of the information of the operation stoppage time acquired by the operation stoppage time information acquisition portion.

2. The maintenance system of an ink jet recording device according to claim 1, further comprising a maintenance level determination criterion correction portion that corrects the maintenance level determination criterion.

3. The maintenance system of an ink jet recording device according to claim 2, further comprising the maintenance level determination criterion correction portion that corrects the maintenance level determination criterion on the basis of the information of the operation stoppage time acquired by the operation stoppage time information acquisition portion.

4. The maintenance system of an ink jet recording device according to claim 1, further comprising:

a job processing time calculation portion that calculates a plurality of job processing times using a time required for processing one job within the plurality of acquired jobs as a job processing time; and a remaining time calculation portion that acquires information of the plurality of job processing times calculated by the job processing time calculation portion and the information of the operation stoppage time acquired by the operation stoppage time information acquisition portion, and calculates a time which is taken until the plurality of acquired jobs are all terminated as a remaining time, wherein the output portion further outputs information of the remaining time calculated by the remaining time calculation portion.

5. The maintenance system of an ink jet recording device according to claim 3, further comprising:

a job processing time calculation portion that calculates a plurality of job processing times using a time required for processing one job within the plurality of acquired jobs as a job processing time; and a remaining time calculation portion that acquires information of the plurality of job processing times calculated by the job processing time calculation portion and the information of the operation stoppage time acquired by the operation stoppage time information acquisition portion, and calculates a time which is taken until the plurality of acquired jobs are all terminated as a remaining time, wherein the output portion further outputs information of the remaining time calculated by the remaining time calculation portion.

6. The maintenance system of an ink jet recording device according to claim 1, further comprising:

a work information acquisition portion that acquires information of replenishment or replacement work of media to be used and/or information of replenishment or replacement work of ink; and an operation stoppage time calculation portion that calculates an operation stoppage time inserted between the jobs, on the basis of the information acquired by the work information acquisition portion, wherein the operation stoppage time information acquisition portion acquires information of the operation stoppage time inserted between the jobs from the operation stoppage time calculation portion.

7. The maintenance system of an ink jet recording device according to claim 2, further comprising an image quality information acquisition portion that acquires information of image quality required for an image to be recorded, wherein the maintenance execution criterion correction portion corrects the maintenance execution criterion on the basis of the information acquired by the image quality information acquisition portion.

8. The maintenance system of an ink jet recording device according to claim 2, further comprising an image quality information acquisition portion that acquires information of image quality required for an image to be recorded, wherein the maintenance level determination criterion correction portion corrects the maintenance level determination criterion on the basis of the information acquired by the image quality information acquisition portion.

9. The maintenance system of an ink jet recording device according to claim 2, further comprising an image type information acquisition portion that acquires information relating to the type of image to be recorded as image type information, wherein the maintenance execution criterion correction portion corrects the maintenance execution criterion on the basis of the image type information acquired by the image type information acquisition portion.

10. The maintenance system of an ink jet recording device according to claim 2, further comprising an image type information acquisition portion that acquires information relating to the type of image to be recorded as image type information, wherein the maintenance level determination criterion correction portion corrects the maintenance level determination criterion on the basis of the image type information acquired by the image type information acquisition portion.

11. The maintenance system of an ink jet recording device according to claim 2, further comprising a media type information acquisition portion that acquires information relating to the type of media to be used as media type information, wherein the maintenance execution criterion correction portion corrects the maintenance execution criterion on the basis of the media type information acquired by the media type information acquisition portion.

12. The maintenance system of an ink jet recording device according to claim 2, further comprising a media type information acquisition portion that acquires information relating to the type of media to be used as media type information, wherein the maintenance level determination criterion correction portion corrects the maintenance level determination criterion on the basis of the media type information acquired by the media type information acquisition portion.

13. The maintenance system of an ink jet recording device according to claim 2, further comprising a mode setting portion that sets an operating mode of the ink jet recording device, wherein the maintenance execution criterion correction portion corrects the maintenance execution criterion on the basis of information of the operating mode set by the mode setting portion.

14. The maintenance system of an ink jet recording device according to claim 2, further comprising a mode setting portion that sets an operating mode of the ink jet recording device, wherein the maintenance level determination criterion correction portion corrects the maintenance level determination criterion on the basis of the information of the operating mode set by the mode setting portion.

15. The maintenance system of an ink jet recording device according to claim 1, further comprising an image reading portion that reads an image recorded on media, wherein the ejection state detection portion detects the ejection state of the ink jet head on the basis of the image read by the image reading portion.

16. The maintenance system of an ink jet recording device according to claim 1, further comprising imaging means for imaging a nozzle surface of the ink jet head, wherein the ejection state detection portion detects the ejection state of the ink jet head on the basis of an image of the nozzle surface imaged by the imaging means.

17. The maintenance system of an ink jet recording device according to claim 16, wherein the imaging means images the nozzle surface by receiving infrared light.

18. The maintenance system of an ink jet recording device according to claim 1, wherein the ink jet head is configured such that a plurality of head modules are replaceably engaged with each other, the maintenance portion is configured to be capable of executing maintenance in units of the head modules, the ejection state detection portion detects the ejection state in units of the head modules, the ejection abnormality level determination portion determines the ejection abnormality level in units of the head modules, the maintenance determination portion determines a necessity of maintenance in units of the head modules, and the maintenance control portion causes the maintenance portion to maintain the ink jet head in units of the head modules.

* * * * *